US005662020A

United States Patent [19]

Morita et al.

[11] Patent Number: 5,662,020

[45] Date of Patent: Sep. 2, 1997

[54] INCHWORM TYPE OF ACTUATOR

[75] Inventors: Hirobumi Morita; Toshikazu Asakura, both of Saitama-ken, Japan

[73] Assignee: Honda Giken Kogyo Kabushiki Kaisha, Tokyo, Japan

[21] Appl. No.: 689,016

[22] Filed: Jul. 30, 1996

[30] Foreign Application Priority Data

| | | | |
|---|---|---|---|
| Jul. 31, 1995 | [JP] | Japan | 7-195009 |
| Jul. 31, 1995 | [JP] | Japan | 7-195010 |
| Jul. 31, 1995 | [JP] | Japan | 7-195011 |
| Jul. 31, 1995 | [JP] | Japan | 7-195012 |
| Jul. 31, 1995 | [JP] | Japan | 7-195013 |
| Jul. 31, 1995 | [JP] | Japan | 7-195014 |
| Oct. 20, 1995 | [JP] | Japan | 7-273211 |
| Oct. 20, 1995 | [JP] | Japan | 7-273212 |
| Oct. 20, 1995 | [JP] | Japan | 7-273213 |

[51] Int. Cl.[6] ..... F15B 15/26

[52] U.S. Cl. ..... 91/44; 91/196; 91/216 R; 92/151; 92/117 A; 92/28; 188/265; 188/67

[58] Field of Search ..... 91/41, 44, 45, 91/508, 520, 525, 196, 216 R; 92/151, 117 R, 117 A, 22, 27, 28; 188/67, 265

[56] References Cited

U.S. PATENT DOCUMENTS

| | | | |
|---|---|---|---|
| 2,988,058 | 6/1961 | Warnecke | 91/44 |
| 3,176,590 | 4/1965 | Uhtenwoldt et al. | 41/44 |
| 3,586,138 | 6/1971 | Engle | 188/265 |
| 4,214,795 | 7/1980 | Kakuminato | 91/41 |
| 4,564,088 | 1/1986 | Takahashi et al. | 188/67 |
| 4,577,732 | 3/1986 | Gottling | 188/265 |
| 4,724,741 | 2/1988 | Wirth | 91/41 |

FOREIGN PATENT DOCUMENTS 47-32631 11/1972 Japan .

*Primary Examiner*—Thomas E. Denion

*Attorney, Agent, or Firm*—Armstrong, Westerman, Hattori, McLeland & Naughton

[57] ABSTRACT

A forward-moving inching unit and a backward-moving inching unit are built in a casing (1) which is slidable relative to a guide member (b). Each of the inching units is made up of an inching piston (60), a brake piston (61) disposed in a direction opposite to the inching piston (60), a lock member (62) disposed between the inching piston (60) and the brake piston (61) to tighten the guide member (b) when pinched between both the pistons (60, 61), a spring (63) for urging the pistons (61) to the right/to the left, a first pressure chamber (64) for pressing the brake piston (61) to the right/to the left, a second pressure chamber (65) for pressing the inching piston (60) in the opposite direction, and a valve block (2) for inputting, at the time of forward-moving inching, a fluid pressure into the second pressure chamber (65) of the forward-moving inching unit and the first pressure chamber (64) of the backward-moving inching unit and for inputting, at the time of backward-moving inching, the fluid pressure into the second pressure chamber (65) of the backward-moving inching unit and the first pressure chamber (64) of the forward-moving inching unit.

31 Claims, 22 Drawing Sheets

INCHWORM TYPE OF ACTUATOR

BACKGROUND OF THE INVENTION

1. Field of the Invention

The present invention relates to an inchworm type of actuator which moves by small degrees or in little increments by one pitch relative to a guide member. It relates, in particular, to an inchworm type of actuator which is suitable as a driving apparatus for changing the position a workpiece receiver on a jig depending on the kind of workpiece. In this specification, the above-described movement by small degrees or in little increments is called "inching" or "an inching movement."

2. Description of the Related Art

As an inchworm type of actuator, there is conventionally known the following one in Japanese Published Unexamined Patent Application No. 32631/1972. Namely, a pair of casings which are telescopically connected via a hydraulic jack are slidably engaged with a bar-like guide member. Each of the casings has assembled or built therein a hydraulic brake unit which locks and unlocks each of the casings relative to the guide member. While keeping the brake unit in one of the casings in a locked condition and the brake unit in the other of the casings in an unlocked condition, the other of the casings is inched (or moved in an inching manner) by the extension operation of the hydraulic jack. Then, while keeping the brake unit in the other of the casings in the locked condition and the brake unit in said one of the casings in the unlocked condition, said one of the casings is inched towards the other of the casings by the contraction operation of the hydraulic jack. By repeating the above operations the actuator is inched by one pitch along the guide member.

In order to improve the control response of the actuator, it is desired to mount on the casing valves which control the supply and discharge of the hydraulic oil to and from the hydraulic lack and the brake units so as to shorten to the maximum extent possible the length of the fluid passages between the hydraulic jack and a valve for the hydraulic jack between the brake units and valves for the brake units.

In the above-described conventional actuator, the hydraulic jack can be integrated with one of the casings. Therefore, in said one of the casings there can be mounted a valve block comprising a valve for the brake unit to be built in said one of the casings and a valve for the hydraulic jack. A fluid pressure supplied through a common piping material to be connected to the valve block can thus be inputted to the brake unit and the hydraulic jack via each of the valves. However, since the other of the casings moves relative to said one of the casings, if a valve for the second brake unit to be built in the other of the casings is contained in the valve block mounted on said one of the casings, the valve block and the second brake unit have to be connected via a flexible hose. This brings about a poor control response of the second brake unit and a poor durability of the flexible hose due to a fatigue by extension and contraction as a result of the relative movement of the other of the casings.

In this case, it may be considered to mount the valve for the second brake unit on the other of the casings. In this arrangement, however, the piping material to be connected to a pressure source must be disposed separately on the side of one of the casings and on the side of the other of the casings, resulting in a troublesome laying out of the piping.

Further, in the above-described conventional actuator, since the inching is made by a pitch corresponding to the stroke of the hydraulic jack in either of the forward and backward movements, the inching pitch for the forward movement and the inching pitch for the backward movement become equal to each other. It follows that, when the actuator is used as a driving apparatus for positioning the workpiece receiver on a jig, the workpiece receiver can be changed in position only by an integer multiple of the inching pitch. Therefore, the freedom in the change in position is lost.

In addition, in the above-described conventional example, the actuator is constituted by two casings which move relative to each other. It is therefore only part (one of the two casings) of the actuator that can be utilized as the member for fixing thereto a driven object such as the workpiece receiver or the like. As a result, the rigidity and the accuracy of positioning of the driven object is impaired.

In view of the above-described disadvantages, the present invention has an object of providing an inchworm type of actuator in which, by enabling the inching movement with the use of a single casing, the layout of the piping material is simplified and the rigidity and accuracy of positioning of the driven object is secured, and the pitch in the forward movement and the pitch in the backward movement can be made different from each other.

SUMMARY OF THE INVENTION

In order to attain the above and other objects, according to a first aspect of the present invention, there is provided an inchworm type of actuator which moves relative to a bar-like guide member, the actuator comprising: a brake unit; a pair of forward-moving and backward-moving inching units, the brake unit and the inching units being built in a casing which is slidable relative to the guide member, the brake unit comprising: a brake piston fitted onto an outer surface of the guide member; a brake reaction force receiving member lying opposite to said brake piston and fixed to the casing; a brake lock member interposed between the brake piston and the brake reaction force receiving member in a condition of being fitted onto the outer surface of the guide member whereby the brake lock member tightens the guide member upon receipt of an urging force from the brake piston toward the brake reaction force receiving member; urging means for urging the brake piston towards the brake reaction force receiving member; and a pressure chamber for urging the brake piston in a direction away from the brake reaction force receiving member, each of the inching units comprising: an inching piston fitted onto the outer surface of the guide member; an inching reaction force receiving member urged in a positive direction towards the inching piston; an inching lock member interposed between the inching piston and the inching reaction force receiving member in a condition of being fitted onto the outer surface of the guide member whereby the inching lock member tightens the guide member upon receipt of an urging force from the inching piston in an opposite direction; and a pressure chamber for urging the inching piston in the opposite direction, the forward-moving direction of the forward-moving inching unit being defined as the positive direction and the backward moving direction thereof as the opposite direction, the backward-moving direction of the backward-moving inching unit being defined as the positive direction and the forward-moving direction thereof as the opposite direction; and fluid supply means for inputting, at the time of forward-moving inching, a fluid pressure into the pressure chamber of the forward-moving inching unit and the pressure chamber of the brake unit and for inputting, at the time of backward-moving inching, the fluid pressure into the pressure chamber of the backward-moving inching unit and the pressure chamber of the brake unit.

According to a second aspect of the present invention, there is provided an inchworm type of actuator which moves relative to a bar-like guide member, the actuator comprising: a forward-moving inching unit; a backward-moving inching unit, each of the inching units being built in a casing which is slidable relative to the guide member; each of the inching units comprising: an inching piston; a brake piston disposed in a direction opposite to the inching piston; a lock member disposed between the inching piston and the brake piston to tighten the guide member when pinched between both the pistons; urging means for urging the brake piston in a positive direction; a first pressure chamber for urging the brake piston in an opposite direction; and a second pressure chamber for urging the inching piston in the opposite direction, the forward-moving direction of the forward-moving inching unit being defined as the positive direction and the backward-moving direction thereof as the opposite direction, the backward-moving direction of the backward-moving inching unit being defined as the positive direction and the forward-moving direction thereof as the opposite direction; and fluid supply means for inputting, at the time of forward-moving inching, a fluid pressure into the second pressure chamber of the forward-moving inching unit and the first pressure chamber of the backward-moving inching unit and for inputting, at the time of backward-moving inching, the fluid pressure into the second pressure chamber of the backward-moving inching unit and the first pressure chamber of the forward-moving inching unit.

According to the first aspect of the present invention, the actuator is normally kept in the locked condition in which the brake lock member tightens the guide member by the urging force of the urging means of the brake piston, whereby the casing is locked to the guide member.

When the fluid pressure is inputted into the pressure chamber of the forward-moving inching unit, the inching lock member of the inching unit is pinched between the inching piston and the inching reaction force receiving member. As a result, the guide member is tightened and the inching piston of the inching unit becomes incapable of moving relative to the guide member. The casing is therefore urged to the forward-moving direction by the reaction force of the fluid pressure inside the pressure chamber. At this time, the fluid pressure is also inputted into the pressure chamber of the brake unit. According to the above operations, the brake lock member is switched to the unlocked condition via the brake piston, and the casing inches to the forward-moving direction by an amount equivalent to the stroke of the inching piston by the fluid pressure inside the pressure chamber.

After this inching movement, the pressure chamber of the brake unit and the pressure chamber of the forward-moving inching unit are both opened to atmosphere. According to these operations, the brake lock member is switched to the locked condition, the casing is locked to the inched position, and the inching lock member is switched to the unlocked condition. Therefore, by the urging force of the inching reaction force receiving member, the inching piston is pushed via the lock member back to the stroke end position of the forward-moving direction relative to the casing, thereby returning to the original condition. By repeating the above-described operations, the casing inches in the forward-moving direction by one pitch by the stroke of the inching piston of the forward-moving inching unit.

When the fluid pressure is inputted into the pressure chamber of the backward-moving inching unit and the pressure chamber of the brake unit, the casing inches by an amount equivalent to the stroke of the inching piston of the backward-moving inching unit by the similar operations as those described above.

In this manner, since the forward moving and the backward moving are effected by using separate inching units, it becomes possible to make different the inching pitch at the time of forward movement and the inching pitch at the time of backward movement.

Further, since the casing is single in number, it becomes possible to mount on the casing a valve block, which constitutes the fluid supply means, having therein a valve for the brake unit, a valve for the forward-moving inching unit, and a valve for the backward-moving inching unit, thereby inputting the fluid pressure, supplied through a common piping material connected to the valve block, to each of the units via each of the valves with a good response. As a result, the layout of the piping material to the actuator is simplified. Further, since the actuator can be constructed in a single casing, the entire actuator can be utilized as a portion to fix thereon a driven object. The rigidity and accuracy of positioning of the driven object can thus be secured.

According to the second aspect of the present invention, normally the first and the second pressure chambers of each of the inching units are both opened to atmosphere. According to this operation, the brake piston of each of the inching units is urged to the positive direction by the urging means, and the lock member is pinched between the brake piston and the inching piston which is in the stroke end position in the positive direction. In this condition, the thrust force in the forward-moving direction to operate on the casing is received by the lock member via the inching piston of the backward-moving inching unit, and the thrust force in the backward-moving direction is received by the lock member via the inching piston of the forward-moving inching unit, whereby the casing is locked to a predetermined position.

When the fluid pressure is inputted into the first pressure chamber of the backward-moving inching unit, the brake piston of the backward-moving inching unit is retreated or moved backward against the urging means. The lock member of the backward-moving inching unit thus becomes the unlocked condition, whereby the casing becomes capable of moving in the forward moving direction. On the other hand, the lock member of the forward-moving inching unit is maintained in the locked condition. Therefore, if the fluid pressure is inputted into the second pressure chamber of the forward-moving inching unit, an urging force in the forward-moving direction is operated on the casing with the inching piston thereof working or operating as a reaction force receiving member. The casing therefore inches in the forward-moving direction by an amount equivalent to the stroke of the forward-moving inching piston.

After this inching movement, the first pressure chamber of the backward-moving inching unit and the second pressure chamber of the forward-moving inching unit are both opened to atmosphere. According to these operations, the lock member of the backward-moving inching unit becomes the locked condition, and the inching piston of the forward-moving inching unit is pushed back to the stroke end position in the forward-moving direction while moving relative to the casing by the urging force from the brake piston thereof, whereby it restores to the original condition. By repeating the above-described operations, the casing inches in the forward-moving direction by one pitch by the stroke of the inching piston of the forward-moving inching unit.

Similarly, when the fluid pressure is inputted into the first pressure chamber of the forward-moving inching unit and the second pressure chamber of the backward-moving inching unit, the casing inches in the backward-moving direction, by the similar operations as above, by the amount equivalent to the stroke of the inching piston of the backward-moving inching unit.

In this manner, also according to the second aspect of the present invention, since the forward moving and the backward moving are effected by using separate inching units, it becomes possible to make different the inching pitch at the time of forward movement and the inching pitch at the time of backward movement.

Further, since the casing is single in number, it becomes possible to mount on the casing a valve block, which constitutes the fluid supply means, having therein a valve for the first pressure chamber and a valve for the second pressure chamber of each of the inching units, thereby inputting the fluid pressure, supplied through a common piping material connected to the valve block, to each of the inching units via each of the valves with a good response. As a result, the layout of the piping material to the actuator is simplified. Further, since the actuator can be constructed in a single casing, the entire actuator can be utilized as a portion to fix thereon the driven object. The rigidity and accuracy of positioning of the driven object can therefore be secured. Still furthermore, since it only need to provide a pair of inching units, the construction becomes simpler as compared with the conventional actuator which is provided with a pair of brake units and a hydraulic jack for inching.

In the actuator according to the first aspect of the present invention, there are the following three types if classified according to the layout of the brake unit, the forward-moving inching unit, and the backward-moving inching unit. Namely, those three types are: a first type in which the brake unit is built in a central portion in an X-axis direction of the casing, and in which the forward-moving inching unit and the backward-moving inching unit are built in axially one end and the other end, respectively, of the casing, the X-axis direction being defined to be a longitudinal direction of the guide member; a second type in which the brake unit is built in at least one of both ends in an X-axis direction of the casing; and a third type in which the guide member is disposed in a pair in parallel with each other, the casing being slidably engaged with both the guide members, and in which the casing has built therein the brake unit positioned on one of the guide members and the forward-moving inching unit and the backward-moving inching unit positioned on the other of the guide members.

When a heavy object is moved by the actuator, it is desired to provide the brake unit in a pair to thereby securely effecting the locking operation. In the first and third types of actuators, it is preferable to dispose the brake unit in a pair in a central portion in the X-axis direction of the casing such that the brake piston of each of the brake units is positioned inwards in the X-axis direction relative to the brake reaction force receiving member, and to constitute the urging means by a common urging means disposed between the brake pistons of both the brake units, thereby sharing parts or members with each other. In the second type of actuator, if the brake unit is disposed in a pair at both end portions in the X-axis direction of the casing such that the brake piston of each of the brake units is positioned outwards in the X-axis direction relative to the brake reaction force receiving member of each of the brake units, the pressure chamber of each of the brake units is disposed inwards in the X-axis direction relative to the brake piston. The fluid supply means can advantageously be disposed in a concentrated manner towards the central portion of the casing.

Further, in the first type of the actuator, if the forward-moving inching unit and the backward-moving inching unit are disposed such that the positive direction of both the inching units looks inwards in the X-axis direction of the casing, the pressure chamber of each of the inching units is disposed inwards in the X-axis direction relative to the inching piston. The fluid supply means can advantageously be disposed in a concentrated manner towards the central portion of the casing. In the second and third types of actuators, if the forward-moving inching unit and the backward-moving inching unit are respectively disposed such that the positive direction of both the inching units looks outwards in the X-axis direction of the casing, and if both the reaction force receiving members of both the inching units are urged in the positive direction by a common urging means provided between the reaction force receiving members of both the inching units, it becomes possible to share parts with each other.

In the actuator according to the second aspect of the present invention, there are the following three types, i.e.: a first type in which the forward-moving inching unit and the backward-moving inching unit are assembled into one half portion and the other half portion in the X-axis direction, respectively, of the casing and in which both the inching units are disposed such that the positive direction of each of them looks outwards in the X-axis direction of the casing, i.e., in which the forward-moving inching unit is disposed inside the half portion on the forward-moving side and the backward-moving inching unit is disposed inside the half portion on the backward-moving side; a second type in which both the inching units are disposed such that the opposite direction of each of the inching units looks inwards in the X-axis direction of the casing, i.e., the backward-moving inching unit is disposed inside the half portion on the forward-moving side and the forward-moving inching unit is disposed inside the half portion on the backward-moving side; and a third type in which the guide member is disposed in a pair in parallel with each other, the casing being slidably engaged with both the guide members, and in which the casing has built therein the forward-moving inching unit positioned on one side of the guide members and the backward-moving inching unit positioned on the other of the guide members.

In the first type, the brake pistons of both the inching units are disposed in close proximity to each other in the central portion of the casing. In this case, it is preferable to share the parts with each other by urging both the brake pistons outwards in the X-axis direction of the casing by a common urging means which is disposed between both.

In the second type, the first pressure chamber and the second pressure chamber of both the inching units are respectively disposed inwards in the X-axis direction of the casing relative to the brake piston and the inching piston. The fluid supply means can therefore be disposed in a concentrated manner towards the central portion of the casing. In the third type according to the first aspect and in the third type according to the second aspect, respectively, of the present invention, the actuator is prevented from rotating by slidably engaging the casing with the pair of guide members which are parallel with each other. Further, instead of providing an engaging portion exclusively for use in rotation prevention, the engaging portion to each of the guide members can be utilized as a space for disposing the brake unit and the inching unit. In this manner, the brake unit and the inching unit can be built in the casing with a good space efficiency, whereby the actuator can be miniaturized and reduced in weight.

As the lock member, there can be used a member like a coned disc spring (also called a "belleville spring like member"). When an urging force from the piston is received, the belleville spring like member elastically deforms by compression in the axial direction, resulting in a reduced inner diameter. A tightening force to tighten the guide member is thus generated. If the spring constant for compression in the axial direction of the lock member is large, the compression pressure increases and, as a result, the urging force of the piston cannot effectively be converted into a tightening force to tighten the guide member. Therefore, it is necessary to form radial slits in the belleville spring like member, which serves as the lock member, to thereby reduce the spring constant for compression. However, since the belleville spring like member is formed by pressing a thin plate into a dish-like shape, if the slits are formed therein, the belleville spring like member is likely to give rise to buckling by the reaction force of tightening the guide member. The guide member will not, therefore, be able to be tightened strong enough.

In order to solve this kind of disadvantage, the lock member may be formed into a member having a plurality of circumferentially divided segment plates whose outer diameter portions are supported by an outer ring. In the above-described first aspect of the present invention, when each of the brake lock member and the inching lock member is constituted into a member having segment plates as described above, there is provided either integrally or separately an outer ring on that side surface of each of the brake piston and the inching piston which lies on the side of the brake reaction force receiving member and the inching reaction force receiving member, respectively. And each of the segment plates is inclined, when an urging force from each of the pistons is received, to a direction to reduce an inclination angle within a range in which the inclination angle exists, the inclination angle being formed relative to a plane perpendicular to the guide member by a line connecting a corner of each of the segment plates in an outer diameter portion thereof on a side of each of the pistons and a corner of the segment plates in an inner diameter portion thereof on a side of each of the reaction force receiving members, whereby a tightening force to the guide member is generated. Further, in the second aspect of the present invention, there is provided an outer ring on that side surface of the inching piston which lies on the side of the brake piston, either integrally or separately. And each of the segment plates is inclined, when pinched between the inching piston and the brake piston, to a direction to reduce an inclination angle within a range in which the inclination angle exists, the inclination angle being formed relative to a plane perpendicular to the guide member by a line connecting a corner of each of the segment plates in an outer diameter portion thereof on a side of one of the pistons and a corner of the segment plates in an inner diameter portion thereof on the side of the other of the pistons, whereby a tightening force to the guide member is generated.

Since the segment plates are divided from each other in the circumferential direction, there will occur no compression reaction force in the axial direction, unlike in the case of the belleville spring like lock member, and the urging force from the piston is not offset or reduced by the compression reaction force, but functions as the urging force to the segment plates. Therefore, the urging force from the piston can be efficiently converted to the tightening force of the guide member. Further, the segment plates need not possess elasticity. Therefore, they can be formed by thick plate pieces of high rigidity by casting or forging and can tighten the guide member with a strong force without giving rise to buckling.

When the casing is moved relative to the guide member by releasing the urging by the piston, if the segment plates remain in the inclined posture, there will occur scratching of the guide member by the segment plates. As a solution, it is preferable to interpose between the piston and the segment plates a spring element which is compressed by the inclination of the segment plates so that, when the urging is released, the segment plates can surely be restored to the neutral posture by the restoring force of the spring element. Since the segment plates can be restored to the neutral posture with a slight or small force, the urging force of the spring element can be set small. There will therefore be no adverse effect of the compression reaction force of the spring element on the tightening force to the guide member.

In the first aspect of the present invention, when the brake lock member and the inching lock member are constituted respectively by an outer ring and segment plates, the following arrangement may be employed. Namely, in a condition in which the segment plates of the brake/inching lock member are inclined upon receipt of the urging force from the brake/inching piston, the inclination angle of the connecting line to connect both the above-described corners of the segments relative to the plane perpendicular to the guide member is set relatively large with the brake lock member and is set relatively small with the inching lock member. Then, the inching force can be made large and a stable braking force can be obtained, resulting in an improved reliability in the inchworm type of actuator.

When the lock member is constituted by a belleville spring like member or segment plates, it is preferable, in improving the durability, to interpose a collet member between the lock member and the guide member to thereby tighten the guide member by the lock member via the collet member. In case the collet member is interposed between the inching lock member and the guide member in the first aspect of the present invention, the collet member is provided or formed on the inching reaction force receiving member in a projecting manner. In case the collet member is interposed between the lock member and the guide member in the second aspect of the present invention, the collet member is provided on the brake piston in a projecting manner. In either case, on an outer peripheral surface of the collet member there is formed a stepped portion which abuts that side surface of the lock member which is away from the inching piston so that the lock member is pinched between the inching piston and the stepped portion. Further, in the first aspect of the present invention, in case the collet member is interposed between the brake lock member and the guide member, it is possible to abut the lock member with the side surface of the brake reaction force receiving member to thereby provide the collet member in a manner to axially project from the side surface thereof. However, in order to secure the operation, it is preferable to form the stepped portion in the outer peripheral surface of the collet member to thereby abut the lock member with the stepped portion.

Further, the lock member may be constituted by: an inner ring which is fitted onto an outer surface of the guide member and which can be reduced in diameter and whose outer peripheral surface is formed into a tapered surface with one axial end being larger in diameter; an outer ring which encloses the inner ring with a clearance therebetween and whose inner peripheral surface is formed into a tapered surface with one axial end being larger in diameter; and a plurality of balls interposed between the inner ring and the outer ring. In the first aspect of the present invention, in case each of the brake lock member and the inching lock member is constituted into one having the above type of balls, one and the other of the brake piston and the inching piston and one and the other of the brake reaction force receiving member and the inching reaction force receiving member are respectively abutted with one and the other axial ends of the inner ring and the outer ring. In the second aspect of the present invention, one and the other of the brake piston and the inching piston are respectively abutted with one axial end of the inner ring and the other axial end of the outer ring.

If the taper angle of the outer peripheral surface of the inner ring is made larger than the taper angle of the inner peripheral surface of the outer ring, and if ball retainers for holding the balls urged in one axial end are provided, the play of the balls relative to both the inner and outer rings is removed. When the urging force from the piston is inputted, the inner ring is instantly reduced in diameter, with the result that an improvement in the response in locking movement can be obtained.

According to the first aspect of the present invention, in case the brake lock member and the inching lock member are respectively constituted by a lock member comprising an inner ring, an outer ring, and balls, the angle of the connecting line to connect the contact point of the balls with the outer peripheral surface of the inner ring and the contact point of the balls with the inner peripheral surface of the outer ring, to the plane perpendicular to the guide member may be set relatively large with the brake lock member and be set relatively small with the inching lock member. Then, the inching force becomes large and a stable braking force can be obtained, with the result that the reliability of the inchworm type of actuator can be improved.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

Figure 1:
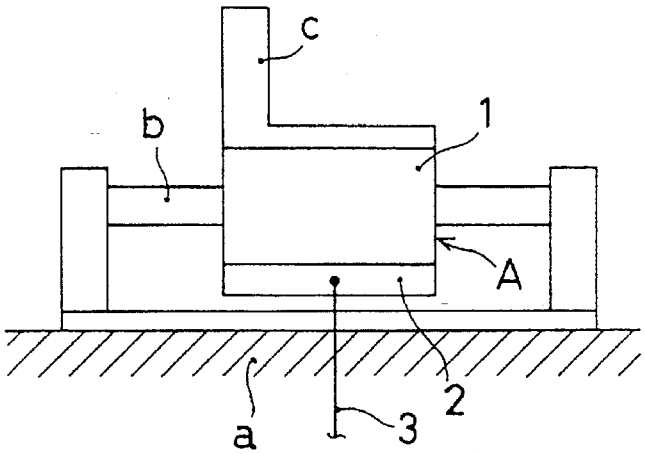
FIG. 1 is a schematic diagram showing an example of use of the actuator according to the present invention.

FIG. 1 shows the portion of arrangement of a workpiece receiver on a jig which is used in a manufacturing line of motor vehicles or the like. On a jig main body "a" there is laterally provided a column-like guide member b. A workpiece receiver c as a driven object is mounted on an inchworm type of actuator A which moves in the right and left direction along the guide member b. It is thus so arranged that the position of the workpiece receiver c can be changed depending on the kind of workpiece.

The actuator A has a casing 1 which can be slidably engaged with the guide member b. A valve block 2 is mounted on an outer surface of the casing 1. A pressurized fluid such as compressed air is supplied to the valve block 2 via a piping material 3 connected to the valve block 2 to thereby operate the actuator A with the air pressure.

Figure 2:
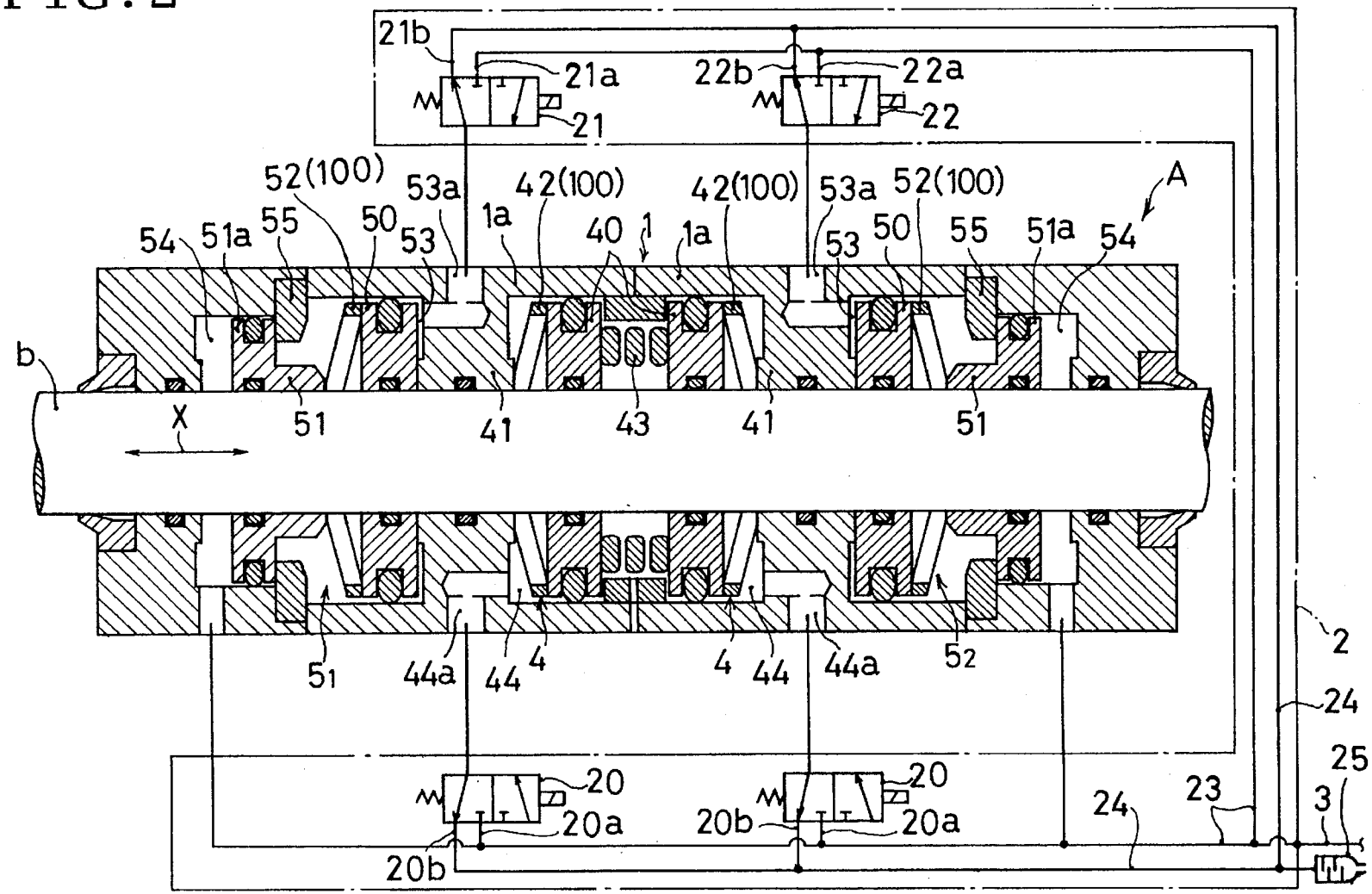
FIG. 2 is a cross-sectional side view of a first example of the actuator according to the present invention.

Details of the actuator A are shown in FIG. 2. In the central portion of the cylindrical casing 1 which is slidably disposed on (or fitted onto an outer surface of) the guide member b, there are assembled (or built in) a pair of right and left brake units 4, 4. In the left end portion of the casing 1 there is assembled an inching unit $\mathbf{5}_1$ for rightward movement (also called a right-moving inching unit $\mathbf{5}_1$). In the right end portion of the casing 1 there is built in an inching unit $\mathbf{5}_2$ for the leftward movement (also called a left-moving inching unit $\mathbf{5}_2$).

Each of the brake units 4 is provided with: a brake piston 40 (i.e., a piston for performing braking) which is fitted onto the outer surface of the guide member b; a brake reaction force receiving member 41 (i.e., a member for receiving a reaction force at the time of braking) which lies opposite to the brake piston 40 and which is fixed to the casing 1; and a brake lock member 42 (i.e., a locking member for performing braking) which is interposed between the brake piston 40 and the brake reaction force receiving member 41 in a condition of being fitted onto the outer surface of the guide member b. The brake lock member 42 tightens the guide member b when an urging or pushing force from the brake piston 40 towards the brake reaction force receiving member 41 is received, whereby the casing 1 is locked relative to the guide member b.

Each of the brake units 4 is further provided with: an urging (or biassing) means 43 which urges the brake piston 40 in a direction of locking the brake lock member 42, namely towards the brake reaction force receiving member 41; and a pressure chamber 44 which urges the brake piston 40 in a direction of unlocking the brake lock member 42. Normally, the brake lock member 42 is kept in a locked condition by the urging force of the urging means 43. But the brake lock member 42 can be switched to the unlocked condition by the input of air pressure from an air supply and discharge port 44*a* to the pressure chamber 44.

Although the urging means 43 is constituted (or constructed) by a coil spring, it may also be constituted by an air or pneumatic spring or the like. In addition, it is also possible to dispose the brake reaction force receiving member 41 inwards in an X-axis direction of the casing 1 relative to the brake piston 40, where the X-axis direction is defined to be in the longitudinal direction (i.e., right and left direction) of the guide member b, to thereby set the locking direction of the brake lock member 42 inwards in the X-axis direction of the casing 1. In the present example, however, the brake reaction force receiving member 41 is disposed outwards in the X-axis direction of the casing 1 relative to the brake piston 40 to thereby set the locking direction outwards in the X-axis direction of the casing 1. It is thus so arranged that the brake pistons 40, 40 of both the brake units 4, 4 can be urged towards the locking direction by a common urging means 43.

The right-moving inching unit $5_1$ is provided with: an inching piston 50 which is fitted onto the outer surface of the guide member b; an inching reaction force receiving member 51 which is urged to the right towards the inching piston 50; an inching lock member (i.e., a member to lock for the inching movement) 52 which is interposed between the inching piston 50 and the inching reaction force receiving member 51 in a condition of being fitted onto the outer surface of the guide member b; and a pressure chamber 53 which urges the inching piston 50 to the left. When the air pressure is inputted to the pressure chamber 53 via an air supply and discharge port 53*a*, the inching lock member 52 is axially pressed between the inching piston 50 and the inching reaction force receiving member 51 by the leftward urging force from the inching piston 50, thereby becoming the locked condition in which the guide member b is tightened. The leftward movement of the inching piston 50 relative to the guide member b is thus prevented or stopped.

The inching reaction force receiving member 51 is urged to the right by an urging means 54 comprising a pneumatic spring at a piston portion 51*a* which is formed in the rear end portion thereof. When the inching piston 50 has reached the rightward stroke end position, the rightward movement of the inching reaction force receiving member 51 is restricted by a stopper portion 55 which is fixed to the casing 1. Therefore, the inching lock member 52 is not normally pressed in the axial direction, but is maintained in the unlocked condition. The urging means 54 of the inching reaction force receiving member 51 may also be constituted by a coil spring or the like, instead of a pneumatic spring.

The left-moving inching unit $5_2$ is the same in construction itself as the right-moving inching unit $5_1$ except that the directivity is opposite to that of the right-moving inching unit $5_1$. Therefore, an explanation thereof is omitted by affixing or giving the same reference numerals to the same members (or parts) as those of the right-moving inching unit $5_1$.

The casing 1 is constituted by diving it into right and left halves 1*a*, 1*a*. After having assembled a subassembly which is made up by building an inching unit and a brake unit in each of the halves 1*a*, 1*a*, both the halves 1*a*, 1*a* are connected together to assemble the actuator A. In this case, the subassemblies of both the halves 1*a*, 1*a* have exactly the same constitution and are therefore superior in productivity in mass production.

In the valve block 2 which is mounted on the casing 1, there are provided: a pair of brake valves 20, 20 which control the supply and discharge of the air to and from the pressure chambers 44, 44 of the pair of brake units 4, 4; a valve 21 for the rightward movement (also called a right-moving valve 21) which controls the supply and discharge of the air to and from the pressure chamber 53 of the right-moving inching unit $5_1$; and a valve 22 for the leftward movement (also called a left-moving valve 22) which controls the supply and discharge of the air to and from the pressure chamber 53 of the left-moving inching unit $5_2$. Each of these valves 20, 21, 22 is constituted by a solenoid valve and is controlled for switching by a signal from a controller (not illustrated). Air supply port 20*a*, 21*a*, 22*a* and air discharge port 20*b*, 21*b*, 22*b* of each of the valves 20, 21, 22 are connected to a common piping material 3 and to a silencer 25 which opens to atmosphere, via air supply and air discharge manifold passages 23, 24, respectively, inside the valve block 2. Even in case each of the valves 20, 21, 22 is separately mounted on the casing 1, a manifold can be mounted on the casing 1 so that the air can be supplied from the common piping material 3 to each of the valves 20, 21, 22.

It is also possible to provide the left-moving inching unit $5_2$ on the left end portion of the casing 1 and the right-moving inching unit $5_1$ on the right end portion thereof. In such an arrangement, however, the pressure chamber 53 for each of the inching units $5_1$, $5_2$ must be disposed outwards in the X-axis direction of the casing 1 relative to the inching piston 50. It results in a longer distance between the air supply and discharge ports 53*a*, 53*a* of both the inching units $5_1$, $5_2$. On the other hand, by providing the right-moving inching unit $5_1$ on the left end and the left-moving inching unit $5_2$ on the right end, respectively, of the casing 1 as in the present example, the pressure chamber 53 of each of the inching units $5_1$, $5_2$ is disposed inwards in the X-axis direction of the casing 1 relative to the inching piston 50. Therefore, the distance between the air supply and discharge ports 53*a*, 53*a* of both the inching units $5_1$, $5_2$ becomes shorter, resulting in miniaturization of the valve block 2.

The operation or function of the above-described actuator A will now be explained.

Figure 3A:
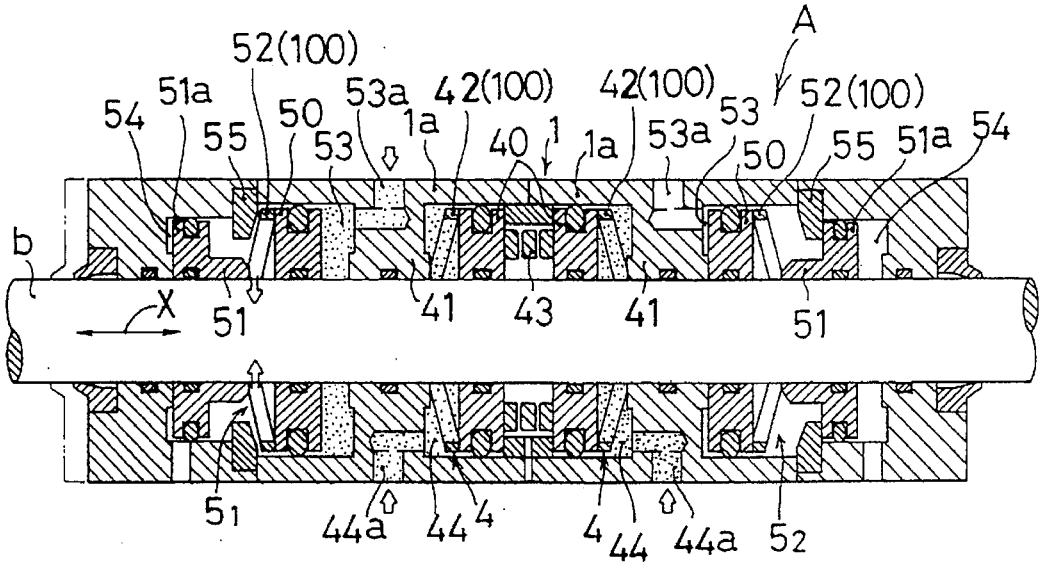
FIGS. 3A and 3B are cross-sectional side views showing the operation of the first example.

When the actuator A is moved to the right, first the air pressure is inputted to the pressure chamber 53 of the right-moving inching unit $5_1$ to thereby switch the inching lock member 52 of the right-moving inching unit $5_1$ into the locked condition. The leftward movement of the inching piston 50 of the right-moving inching unit $5_1$ is thus prevented. Then, the air pressure is inputted to the pressure chambers 44, 44 of both the brake units 4, 4 to thereby switch the brake lock members. 42, 42 of both the brake units 4, 4 into the unlocked condition. According to these operations, by the reaction force due to the air pressure inside the pressure chamber 53 of the right-moving inching unit $5_1$, the casing 1 inches (i.e., moves in an inching manner) to the right, as shown in FIG. 3A, by an amount equivalent to the stroke of the inching piston 50. In the illustrated example, the stroke of the inching piston 50 is restricted by the stroke of the inching reaction force receiving member 51. It may also be so arranged that the stroke of the inching piston 50 is restricted by the abutment of the stopper portion 55 with the inching lock member 52.

Figure 3B:
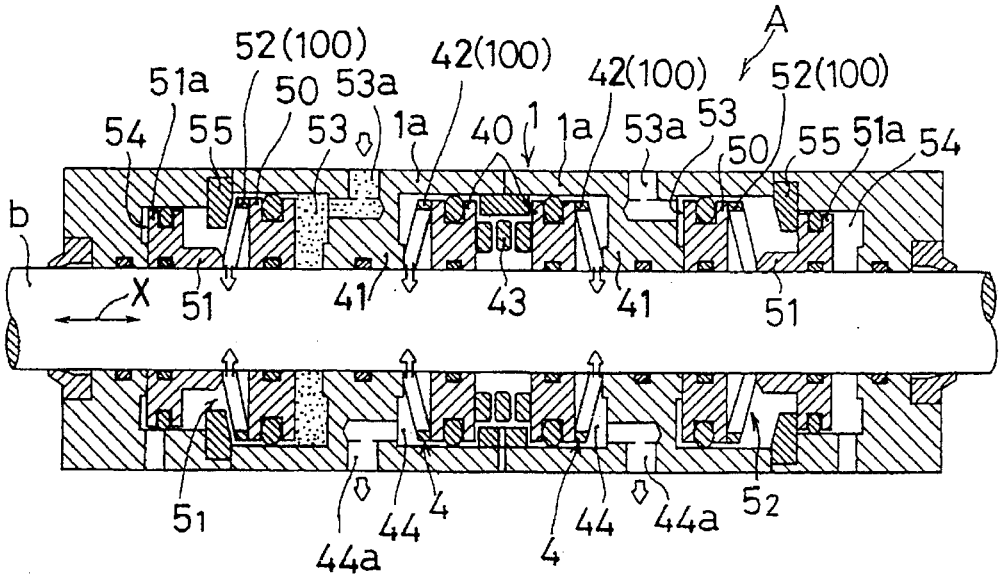

Once the casing 1 has inched as explained above, the pressure chambers 44, 44 of both the brake units 4, 4 are opened to atmosphere to thereby switch the brake lock members 42, 42 of both the brake units 4, 4 into locked condition, as shown in FIG. 3B. Then, the pressure chamber 53 of the right-moving inching unit $5_1$ is opened to atmosphere. According to these operations, the inching lock member 52 is switched to the unlocked condition. Due to the urging force of the inching reaction force receiving member 51, the inching piston 50 is pushed back, via the inching lock member 52, to the rightward stroke end position while moving relative to the casing 1 and the guide member b. The inching piston 50 thus returns to the condition as shown in FIG. 2.

By repeating the above-described operations, the casing 1 inches to the right by a pitch equivalent to the stroke of the inching piston 50 of the right-moving inching unit $5_1$.

If the air supply and discharge to and from the pressure chamber 53 of the left-moving inching unit $5_2$ are made instead of to and from the right-moving inching unit $5_1$, the casing 1 inches to the left by a pitch equivalent to the stroke of the inching piston 50 of the left-moving inching unit $5_2$ in a similar operation as described above.

Here, in the illustrated example, the stroke of the inching piston of each of the inching units $5_1$, $5_2$ is set equal to each other. If the strokes are set at different values, the position of the workpiece receiver c can be varied at a relatively large freedom. For example, if the piston stroke of the right-moving inching unit $5_1$ is set to 5 mm and that of the left-moving inching unit $5_2$ is set to 2 mm, the workpiece receiver c can be displaced to the right by 1 mm by inching once to the right and inching twice to the left. It becomes thus possible to change the position by a more minute pitch than the strokes of the pistons.

Figure 4:
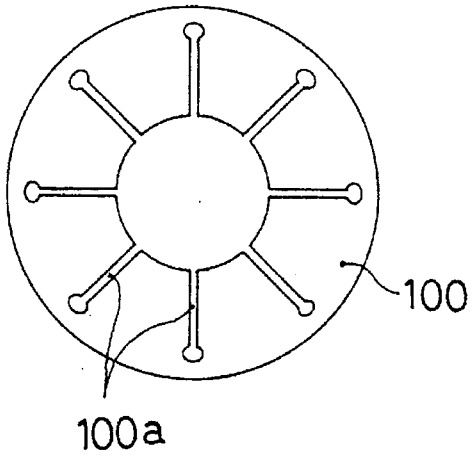
FIG. 4 is a front view of a belleville spring like member to be used as a lock member in the first example of the present invention.

In the above-described example, each of the brake lock member 42 and the inching lock member 52 (hereinafter also called as "brake/inching lock member 42, 52") is constituted, as shown in FIG. 4, by a belleville spring like member 100 having formed therein radial slits 100*a* which extend from an inner peripheral side to a radially intermediate position. When the belleville spring like member 100 receives an urging force from each of the brake piston 40 and the inching piston 50 (hereinafter also called as "brake/inching piston 40, 50") towards each of the brake reaction force receiving member 41 and the inching reaction force receiving member 51, respectively (hereinafter also called as "brake/inching reaction force receiving member 41, 51"), the belleville spring like member 100 is compressed in the axial direction. The inner diameter thereof is thus reduced and the guide member b is tightened.

Figure 5:
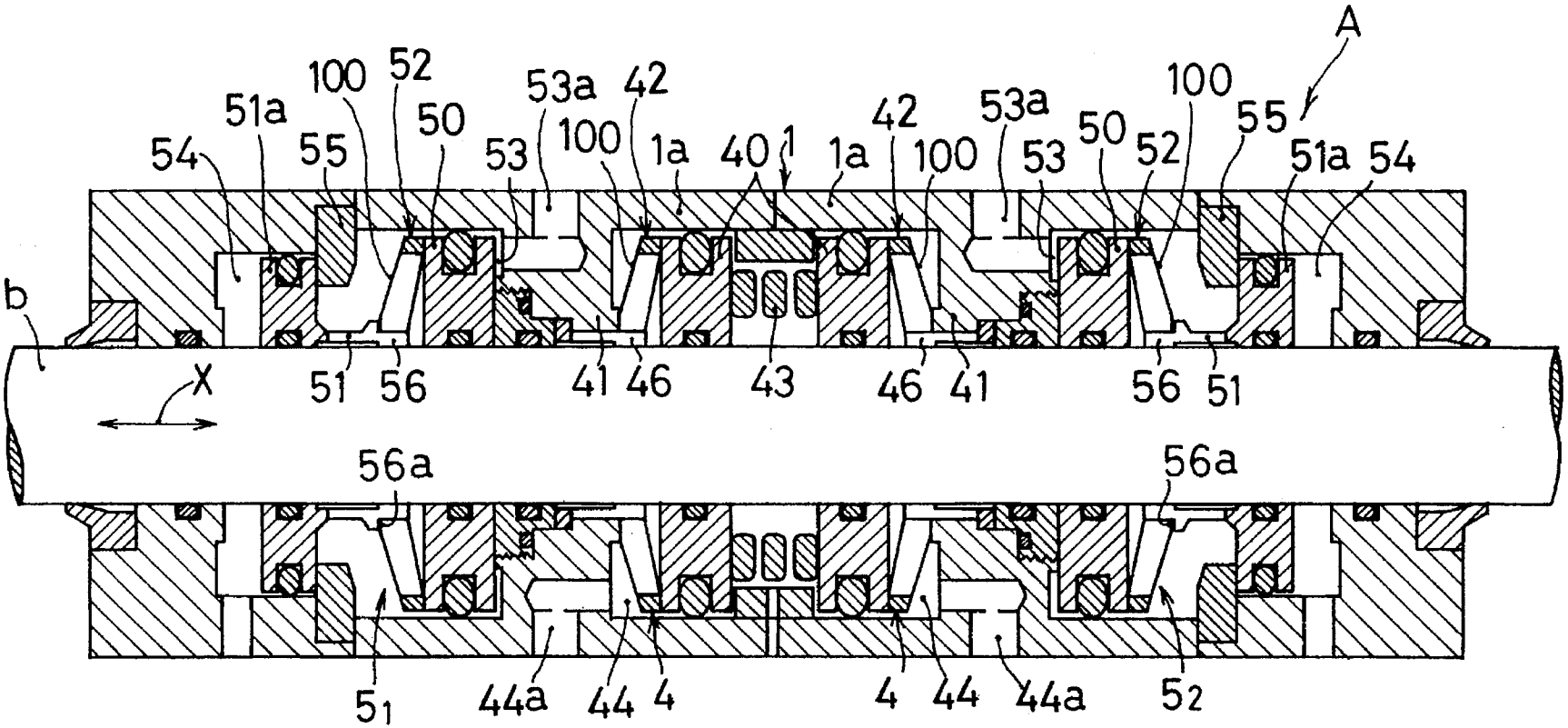
FIG. 5 is a cross-sectional side view of a second example of the actuator according to the present invention.

The following arrangement may also be employed as shown in FIG. 5. Namely, on each of the brake/inching reaction force receiving member 41, 51, there is provided in a projecting manner a collet member 46, 56 which can be reduced in diameter and which is interposed between the belleville spring like member 100, which serves as the brake/inching lock member 42, 52, and the guide member b. The guide member b is thus tightened by the belleville spring like member 100 via the collet member 46, 56. On an outer peripheral surface of the collet member 56 which projects from the inching reaction force receiving member 51, there is formed a stepped portion 56*a* which abuts that side of the inching lock member 52 which lies away from the inching piston 50. It is thus so arranged that the inching lock member 52 is pinched between the stepped portion 56*a* and the inching piston 50.

Figure 6:
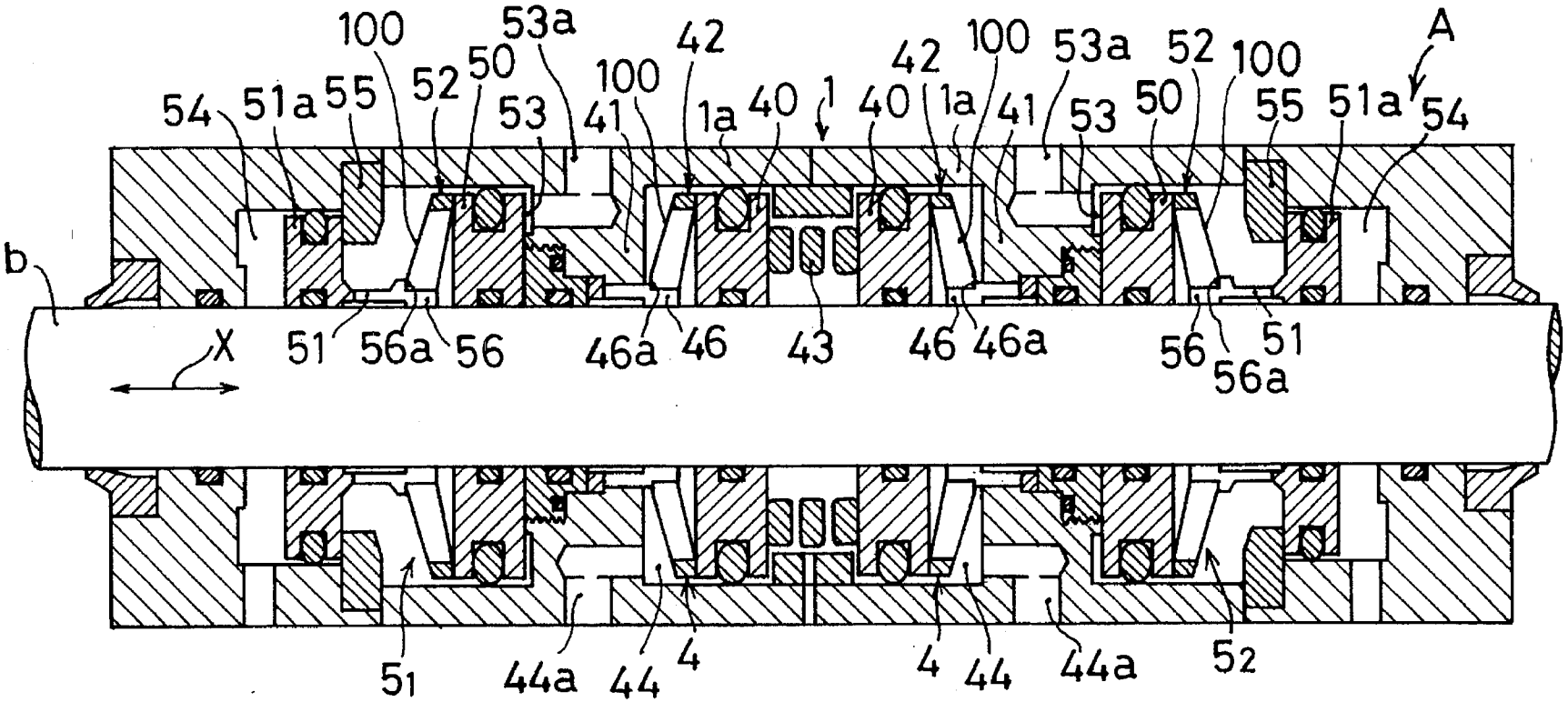
FIG. 6 is a cross-sectional side view of a third example of the actuator according to the present invention.

The collet member 46, which is provided in a manner projecting from the brake reaction force receiving member 41, is fixed at its bottom end portion by insertion into the brake reaction force receiving member 41. When the collet member 46 is reduced in diameter at the time of locking by the brake lock member 42, there will be a clearance, though very small, between the inner circumference of the brake reaction force receiving member 41 and the collet member 46. Here, in the example shown in FIG. 5, since the brake lock member 42 is directly abutted with the brake reaction force receiving member 41, scratches to be generated by scratching between the brake lock member 42 and the brake reaction force receiving member 41 may find their way into the above-described clearance. As a result, even if the urging by the brake piston 40 is released, the collet member 46 may sometimes remain reduced in diameter and unlocking of the collet member 46 sometimes fails. In order to solve this kind of disadvantage, the following arrangement may be employed. Namely, as shown in FIG. 6, on an outer periphery of the collet member 46 there is formed a stepped portion 46*a* which abuts that side surface of the brake lock member 42 which lies away from the brake piston 40, whereby the urging force from the brake piston 40 is received by this stepped portion 46*a*.

Figure 7:
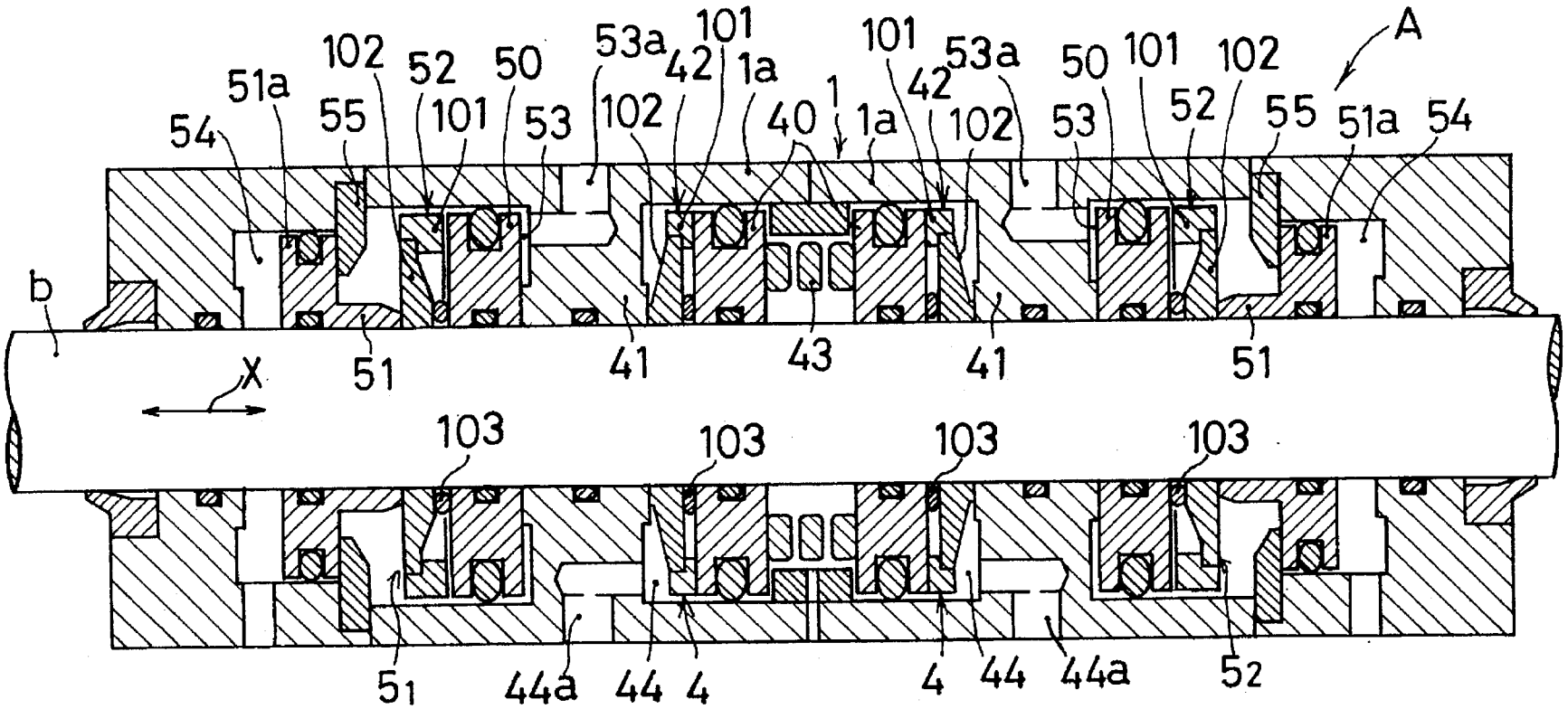
FIG. 7 is a cross-sectional side view of a fourth example of the actuator according to the present invention.
Figure 8:
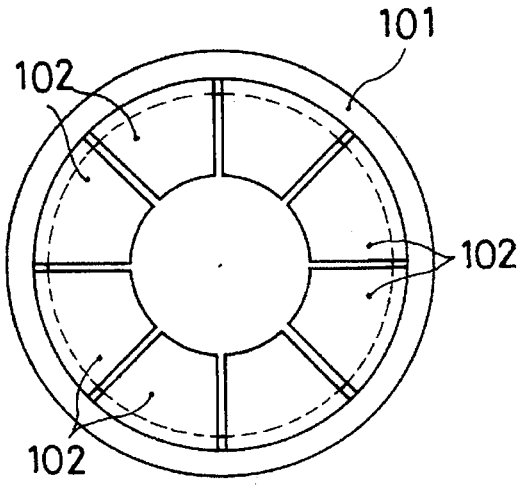
FIG. 8 is a front view of a lock member to be used in the fourth example of the present invention.

FIG. 7 shows still another example of the inchworm type of actuator. The brake/inching lock member 42, 52 is constituted by: an outer ring 101 which is provided on that side surface of the brake/inching piston 40/50 which lies on the side of the brake/inching reaction force receiving member 41, 51 either integrally with, or separately from, the above-describe piston 40, 50 (separately in the illustrated example); and a plurality of segment plates 102 which are segmented or divided in the circumferential direction and which are supported at their outer diameter portions by the outer ring 101 as shown in FIG. 8.

The segment plates 102 are constituted by thick plate pieces of high rigidity formed by casting, forging or the like. The inner diameter portion of each of the segment plates 102 is formed thicker, and the inner diameter end surface 102*a* (FIGS. 9A, 9B) is formed into a cylindrical surface having a generatrix which extends in the longitudinal direction of the guide member b.

In a condition in which no urging force from the above-described piston 40, 50 is received, i.e., in the unlocked condition of the brake/inching lock member 42, 52, the segment plates 102 are held in a neutral posture in which the generatrix of the inner diameter end surface 102*a* becomes parallel to the axial line of the guide member b. The segment plates 102 can therefore smoothly slide relative to the guide member b without giving rise to scratching.

Figure 9A:
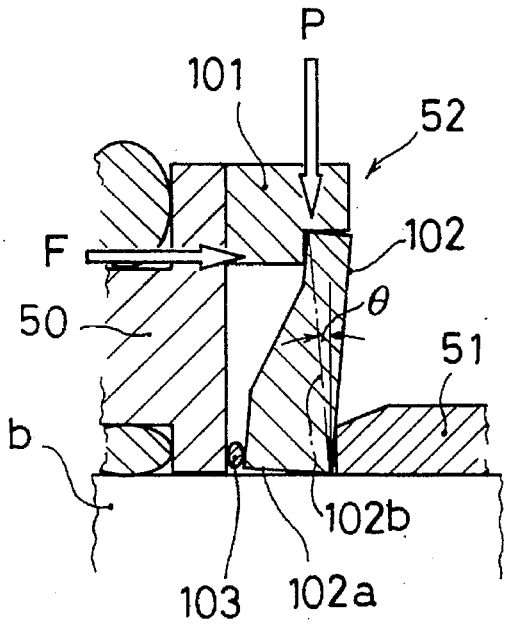
FIG. 9A is a cross-sectional side view of an inching lock member to be used in the fourth example and FIG. 9B is a cross-sectional side view of a brake lock member to be used in the fourth example of the present invention.
Figure 9B:
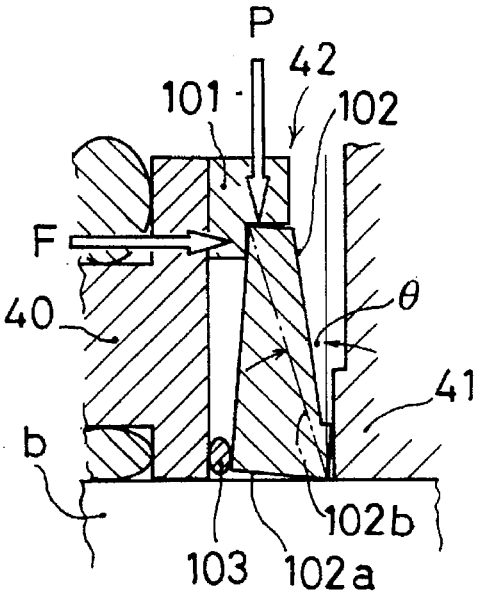

When the urging force from the brake/inching piston 40, 50 is received via the outer ring 101, each of the segment plates 102 is tilted or inclined, as shown in FIGS. 9A and 9B, towards the brake/inching reaction force receiving member 41, 51 with the portion of abutment with the brake/inching reaction force receiving member 41, 51 serving as a fulcrum. At this time, since the diametrically outward displacement of the segment plate 102 at that corner of the outer diameter portion which lies on the side of the piston 40, 50 is restricted by the outer ring 101, that corner of the diametrically inner portion of the segment plate 102 which lies on the side of the brake/inching reaction force receiving member 41, 51 is displaced diametrically inwards. The guide member b is consequently tightened. Further, since the segment plates 102 can be formed with plate pieces of high rigidity as described above, it becomes possible to tighten the guide member b with a strong force without giving rise to buckling. The locking can therefore be done securely.

Figure 10:
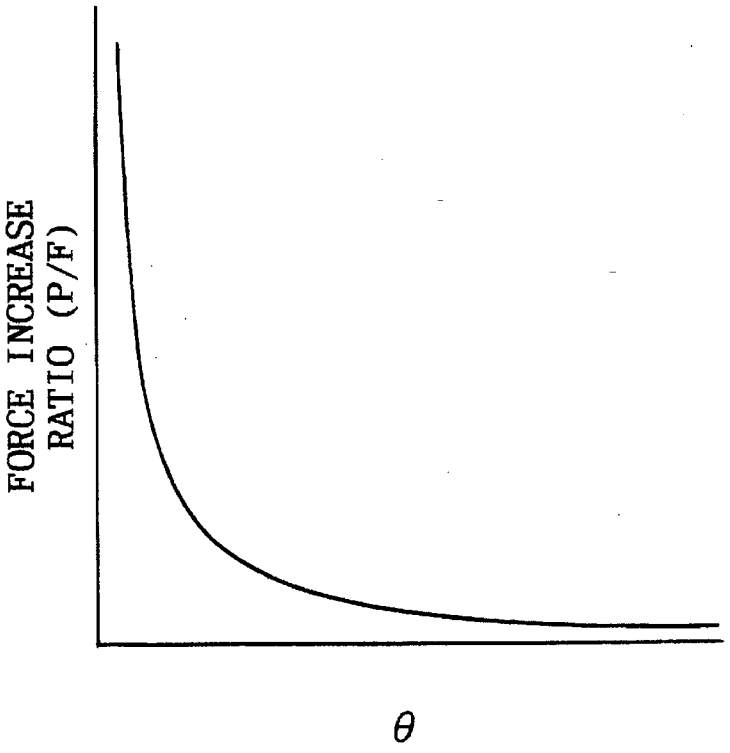
FIG. 10 is a graph showing the characteristics of the lock member to be used in the fourth example of the present invention.

In order to generate the tightening force to the guide member b, it is necessary for the connecting line 102*b* connecting both the above-described corners to remain inclined towards the brake/inching piston 40, 50 relative to the plane at right angles to the guide member b. Let this inclination angle be 8, then the tightening force P to the guide member b can be expressed by the following formula $$P=F/\tan\theta$$

where F is the urging force to be operated on the segment plates 102. It follows that the force increase ratio of the tightening force P to the urging force F varies with the inclination angle θ as shown in FIG. 10. If the inclination angle θ is small, the force increase ratio becomes large, and a sufficient tightening force P is generated even while the urging force F is still small, resulting in the locked condition. On the other hand, if the inclination angle θ is large, though the force increase ratio becomes small, the change in the tightening force P due to fluctuation in the urging force F becomes small, whereby the braking force can be stabilized.

Until the brake/inching lock member 42, 52 becomes the locked condition, the urging force F must be received by the brake/inching reaction force receiving member 41, 51. In addition, at the time of inching, since the casing 1 is urged by the urging means 54 of the inching reaction force receiving member 51 in the direction opposite to that of inching, the inching force is reduced by the amount equivalent to the urging force of the inching reaction force receiving member 51. In such a case, if the segment plates 102 of the inching lock member 52 is formed such that the inclination angle θ in the inclined condition becomes relatively small as shown in FIG. 9A, the locked condition is attained in a region of small urging force F. Therefore, the urging force of the inching reaction force receiving member 51 may be small, and the inching force may be made correspondingly larger.

On the other hand, the brake lock member 42 must be so arranged, in maintaining the workpiece receiver c in a predetermined position, that a stable braking force can be obtained even if the urging force of the brake piston 40 is fluctuated. For that purpose, it is preferable to form the segment plates 102 of the brake lock member 42 with a relatively larger inclination angle θ in the inclined condition as shown in FIG. 9B.

Even after the urging by the piston 40, 50 has been released, the segment plates 102 may sometimes remain in the inclined posture. There is consequently a possibility that scratching occurs between the segment plates 102 and the guide member b when the segment plates 102 move relative to the guide member b. As a solution, a spring element 103 which is compressed by the inclination of the segment plates 102 is interposed between the brake/inching piston 40, 50 and the segment plates 102. It is thus so arranged that, when the urging of the brake/inching piston 40, 50 is released, the segment plates 102 can surely be restored to a neutral posture by the elastic restoring force of the spring element 103. In this case, since the restoring of the segment plates to the neutral posture can be effected with a small force, the urging force of the spring element 103 may be set to a small value. It follows that the tightening force to the guide member b will not be reduced due to the compression reaction force of the spring element 103. In the illustrated example, the spring element 103 is constituted by an O-ring. However, other spring members such as a coil spring or the like may also be used.

Figure 11:
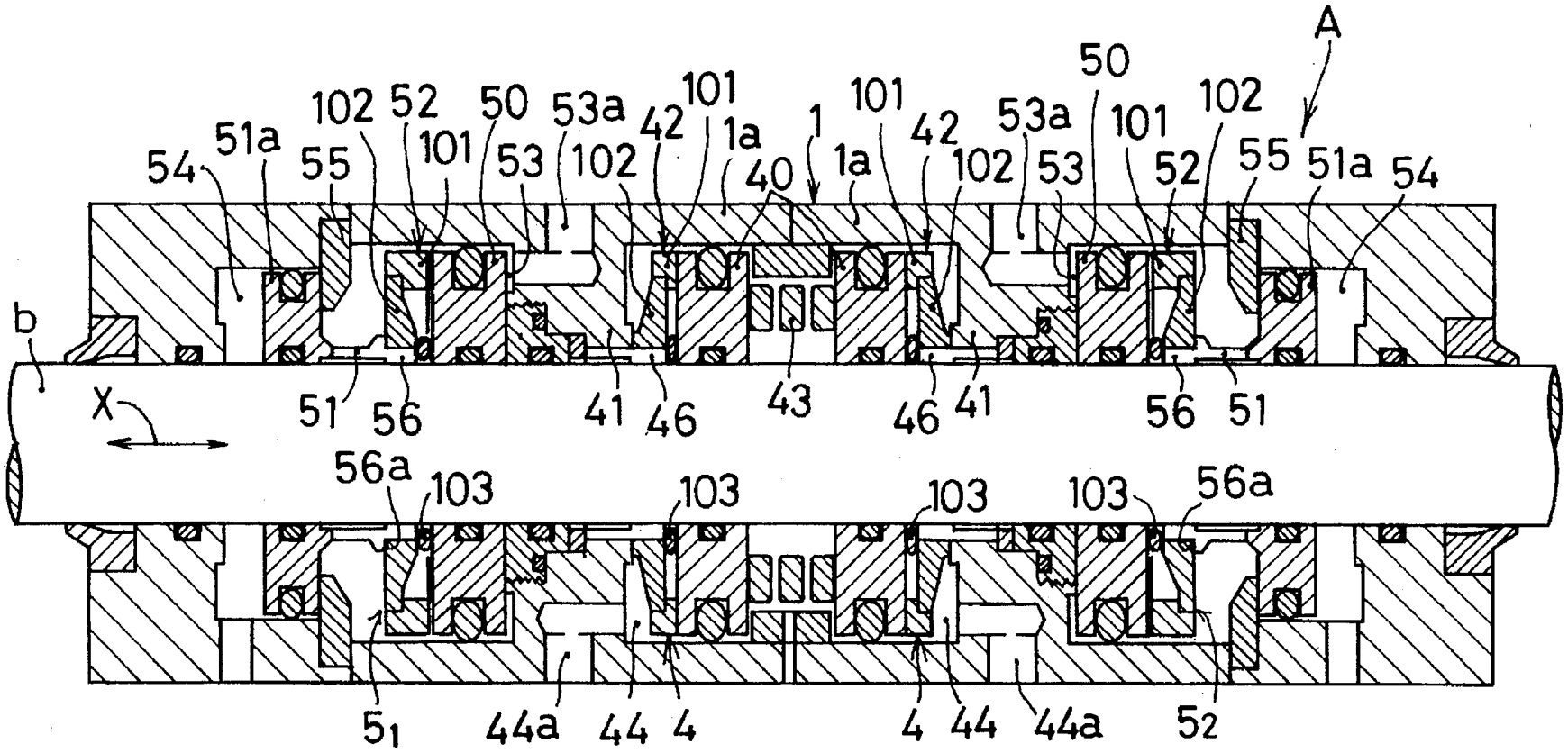
FIG. 11 is a cross-sectional side view of a fifth example of the actuator according to the present invention.

Further, in the example shown in FIG. 7, it is so arranged that the guide member b is directly tightened by the segment plates 102. However, as in the example shown in FIG. 11, the following arrangement may also be employed. Namely, on each of the brake/inching reaction force receiving member 41, 51, there is provided in a projecting manner a collet member 46, 56 which can be reduced in diameter and which is interposed between the segment plates 102 of the brake/inching lock member 42, 52 and the guide member b. The guide member b is thus tightened by the inclination of the segment plates 102 via the collet member 46, 56. According to this arrangement, since there occurs no scratching between the guide member b and the segment plates 102, the spring element 103 can be omitted. In the example shown in FIG. 11, there is formed only in the collet member 56 a stepped portion 56*a* which abuts the segment plates 102. However, the collet member 46 may also be formed into one with a stepped portion.

Figure 12:
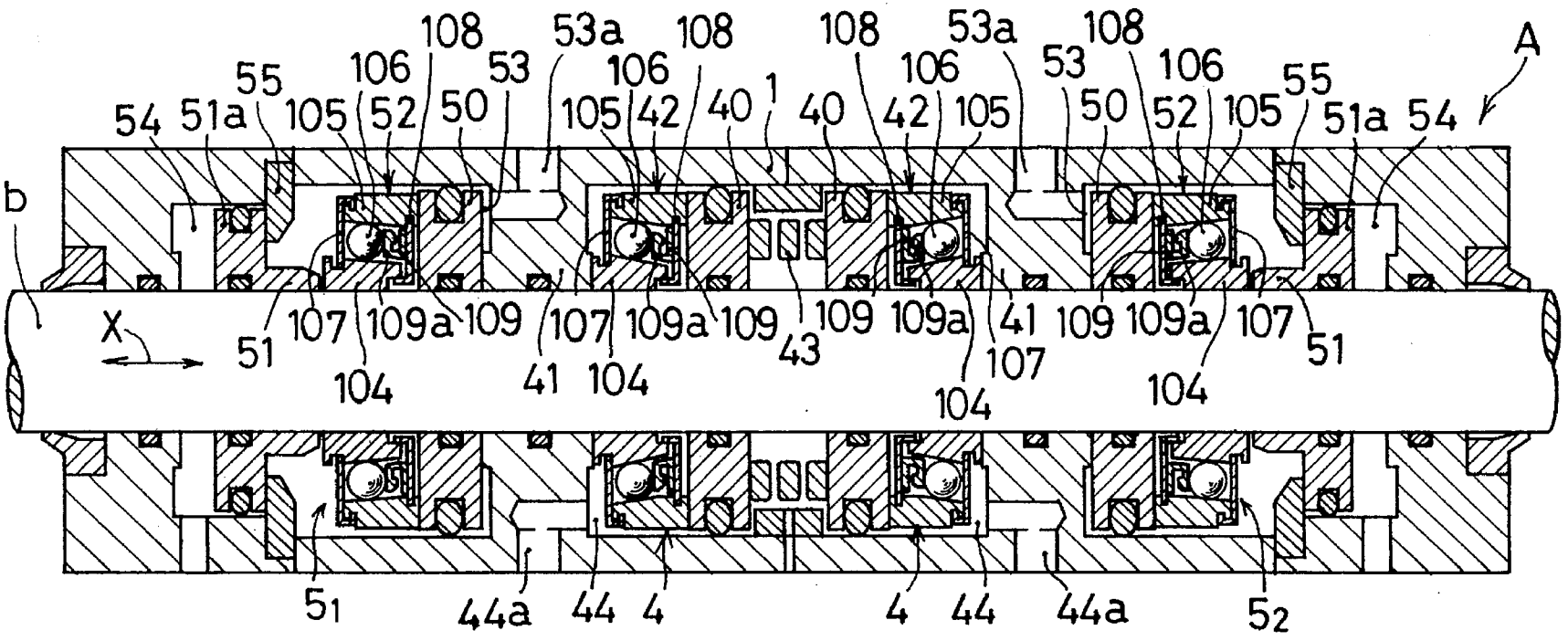
FIG. 12 is a cross-sectional side view of a sixth example of the actuator according to the present invention.

FIG. 12 is a still another example of the inchworm type of actuator. As clearly shown in FIGS. 13 and the brake/inching lock member 42, 52 is constituted by a ball type collet chuck which is made up of: an inner ring 104 which is fitted onto an outer surface of the guide member b and which can be reduced in diameter; an outer ring 105 which encloses the inner ring 104 with a clearance therebetween; and a plurality of balls 106 which are interposed between the inner ring 104 and the outer ring 105.

The inner ring 104 is constituted by a plurality of circumferentially divided segments 104*a*. In order to prevent these segments 104*a* from being taken apart, each of the segments 104*a* is supported on the outer ring 105 by a pair of stopper plates 107, 108 such that the segments 104*a* allow for slight movements in both diametrical and axial directions relative to the outer ring 105. The brake/inching reaction force receiving member 41, 51 is abutted with one axial end of the inner ring 104, and the brake/inching piston 40, 50 is abutted with the other axial end of the outer ring 105. Further, the outer peripheral surface of the inner ring 104 and the inner peripheral surface of the outer ring 105 are respectively formed into tapered surfaces so that axially one end of each becomes larger in diameter. When the inner ring 104 and the outer ring 105 are axially pinched between the brake/inching reaction force receiving member 41, 51 and the brake/inching piston 40, 50 by the urging force of the brake/inching piston 40, 50, the balls 106 are pushed diametrically inwards due to the wedge function of the tapered surfaces to thereby tighten the guide member b. The brake/inching piston 40, 50 may be arranged to abut one axial end of the inner ring 104 and the brake/inching reaction force receiving member 41, 51 may be arranged to abut the other axial end thereof.

In the illustrated example, a taper angle a of the tapered surface on the outer periphery of the inner ring 104 is set larger than a taper angle β of the tapered surface on the inner periphery of the outer ring. There are provided ball retainers 109 which hold the balls 106 in a condition of being urged towards the large-diameter side of the tapered surfaces, i.e., towards one end in the axial direction. According to this arrangement, even in the unlocked condition in which the urging by the brake/inching piston 40, 50 is released, the balls 106 are kept abutted with the outer peripheral surface of the inner ring 104 and the inner peripheral surface of the outer ring 105 to thereby remove the play of the balls 106 relative to both the rings 104 and 105. When the urging force from the brake/inching piston 40, 50 is inputted, the inner ring 104 can therefore be instantly tightened via the balls 106, thereby resulting in an improved response in the locking operation. The ball retainers 109 are formed with an elastic material such as a rubber or the like and is provided with lip portions 109*a* which urge the balls 106 in the axial one direction, and spacer potions 109*b* which are inserted at the pitch of disposing the balls 106.

Here, the connecting line to connect the contact point of the balls 106 with the outer peripheral surface of the inner ring 104 and the contact point of the balls 106 with the inner peripheral surface of the outer ring 105 is inclined relative to the plane perpendicular to the guide member b. Let this inclination angle be θ, then the tightening force P to the guide member b can be expressed by the following formula $$P=F/\tan\theta$$

where F is the urging force of the brake/inching piston 40, 50. It follows that the force increase ratio of the tightening force P to the urging force F varies with the inclination angle θ as shown in FIG. 10. If the angle θ is small, the force increase ratio becomes large, and a sufficient tightening force P is generated while the urging force F is still small, resulting in the locked condition. On the other hand, if the inclination angle θ is large, though the force increase ratio becomes small, the change in the tightening force P due to fluctuations in the urging force F becomes small, whereby the braking force can be stabilized.

Figure 14A:
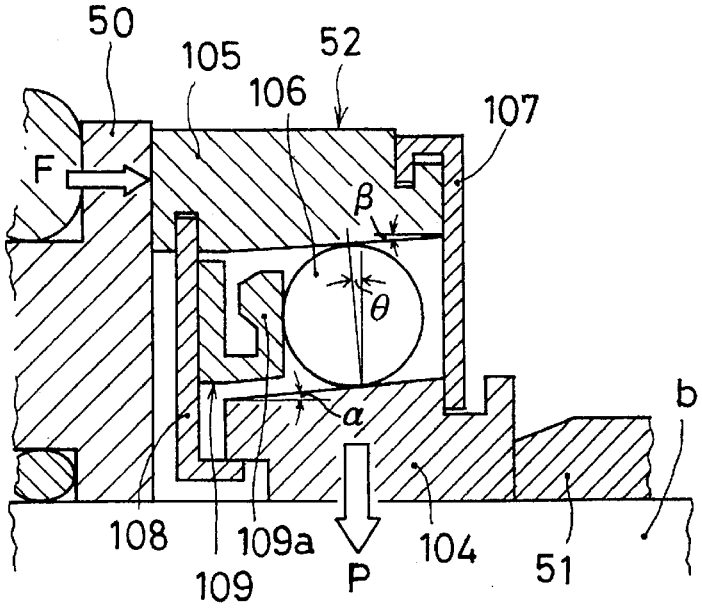
FIG. 14A is a cross-sectional side view of an inching lock member to be used in the sixth example and FIG. 14B is a cross-sectional side view of a brake lock member to be used in the sixth example of the present invention.

Until the brake/inching lock member 42, 52 becomes the locked condition, the urging force F need be received by the brake/inching reaction force receiving member 41, 51. In addition, at the time of inching, the casing 1 is urged by the urging means 54 for the inching reaction force receiving member 51 in the direction opposite to that of inching. Therefore, the inching force is reduced by the amount equivalent to the urging force of the inching reaction force receiving member 51. In such a case, if the inching lock member 52 is formed such that the inclination angle θ becomes relatively small as shown in FIG. 14A, the locked condition is attained in a region of small urging force F. The urging force of the inching reaction force receiving member 51 may thus remain small, and the inching force can be made correspondingly large.

Figure 14B:
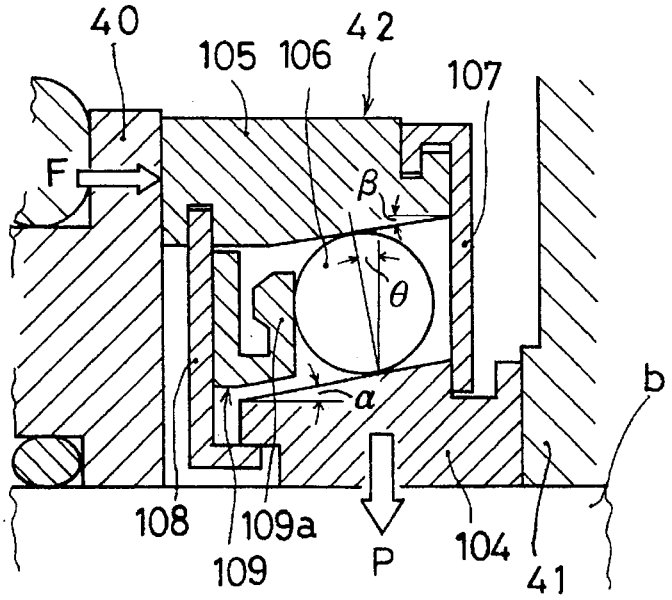

On the other hand, the brake lock member 42 must be so arranged, in maintaining the workpiece receiver c in a predetermined position, that a stable braking force can be obtained even if the urging force of the brake piston 40 is fluctuated. For that purpose, it is preferable to form the brake lock member 42 with a relatively large inclination angle θ as shown in FIG. 14B.

An explanation has so far been made about examples in which a pair of brake units 4, 4 are disposed in the central portion in the X-axis direction of the casing 1. However, as in the example shown in FIG. 15, a pair of brake units 4, 4 may be disposed in both end portions in the X-axis direction of the casing 1, and a pair of right-moving inching unit $5_1$ and left-moving inching unit $5_2$ may be disposed in the central portion in the X-axis direction of the casing 1. The constitution of each of the above-described units 4, $5_1$, $5_2$ is the same as that of the above-described embodiments. Therefore, their explanation is omitted by giving the same reference numerals to the same members or parts.

It is possible to dispose the brake reaction force receiving member 41 outwards in the X-axis direction of the casing 1 relative to the brake piston 40 and to set the locking direction of the brake reaction force lock member 41 outwards in the X-axis direction of the casing 1. However, in the example shown in FIG. 15, the brake reaction force receiving member 41 is set inwards in the X-axis direction of the casing 1 relative to the brake piston 40, and the locking direction is set inwards in the X-axis direction of the casing 1. According to this arrangement, since the pressure chamber 44 of each of the brake units 4, 4 is disposed inwards in the X-axis direction of the casing 1 relative to the brake piston 40, the distance between the supply and discharge ports 44*a*, 44*a* of both the brake units 4, 4 becomes shorter, resulting in miniaturization of the valve block 2.

Further, it is possible to provide the right-moving inching unit $5_1$ on the left side and the left-moving inching unit $5_2$ on the right side. However, as in the example shown in FIG. 15, if the right-moving inching unit $5_1$ is disposed on the right side and the left-moving inching unit $5_2$ on the left side, the inching reaction force receiving member 51 of each of the inching units $5_1$, $5_2$ is disposed inwards in the X-axis direction of the casing 1 relative to the inching piston 50. Therefore, it advantageously becomes possible to urge the inching reaction force receiving members 51, 51 of both the inching units $5_1$, $5_2$ by a common urging means 54 which is disposed therebetween.

In case the actuator is fixed to the guide member so as not to rotate, it is necessary to provide a second guide member which is parallel with the guide member and to form an engaging portion for the second guide member on the casing. However, the actuator is elongated in the longitudinal direction of the guide member and, if engaging portions to prevent the rotation are further provided, the actuator becomes larger in size and weight.

Figure 16:
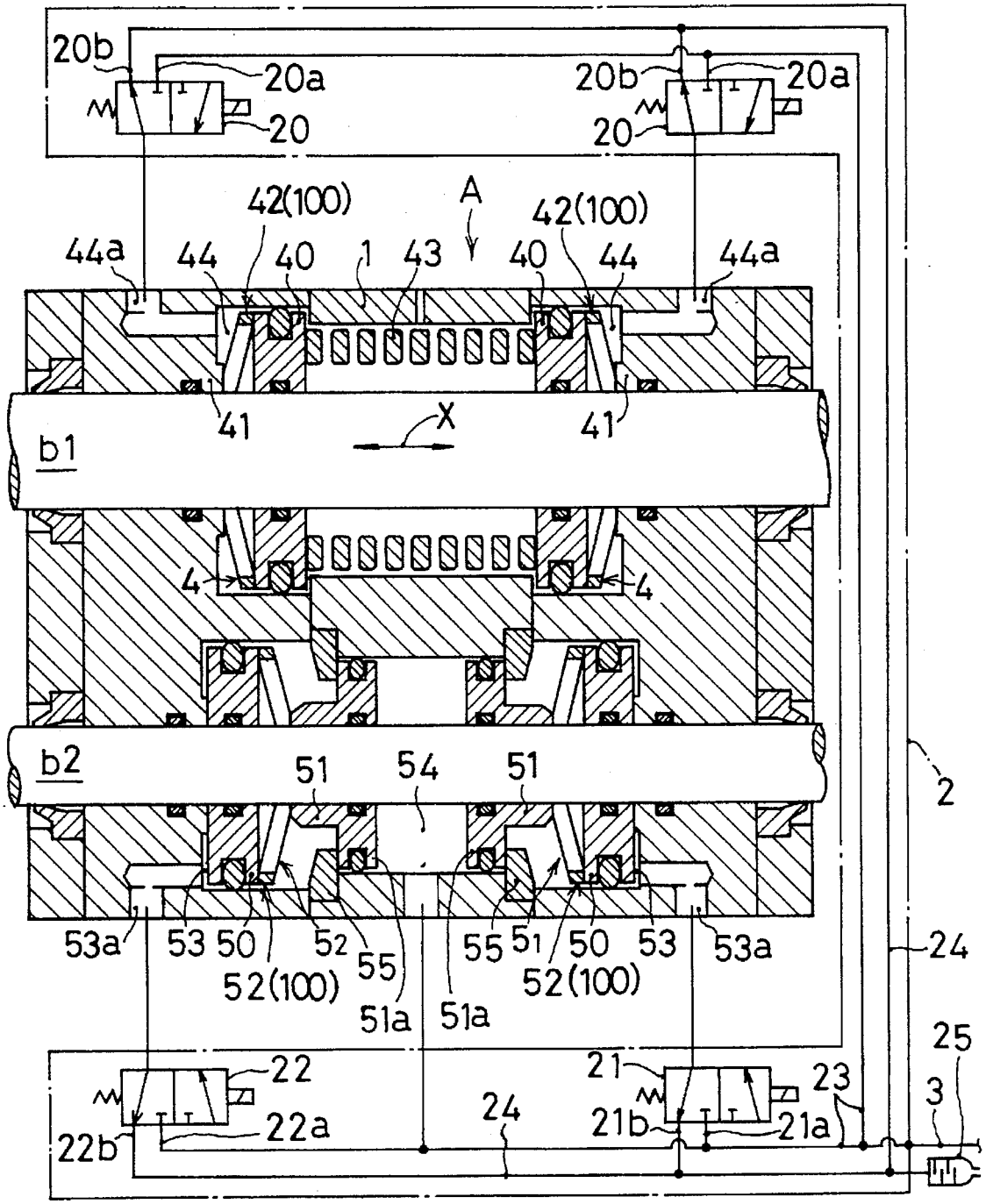
FIG. 16 is a cross-sectional side view of an eighth example of the actuator according to the present invention.

As a solution, in an example shown in FIG. 16, the following arrangement has been employed. Namely, a pair of first and second guide members b1, b2 which are parallel with each other are provided. The casing 1 of the actuator A is slidably engaged with both the guide members b1, b2 to thereby prevent the actuator A from rotating. Further, a pair of brake units 4, 4 are built in the casing 1 in a position on the side of the first guide member b1. A pair of right-moving inching unit $5_1$ and left-moving inching unit $5_2$ are built in the casing 1 in a position on the side of the second guide member b2. The miniaturization of the actuator A is thus sought for. The constitution of each of the units 4, $5_1$, $5_2$ is the same as that of the above-described examples. Therefore, its explanation is omitted by giving the same reference numerals to the same members or parts. Further, in the example shown in FIG. 16, the brake reaction force receiving members 41, 41 are disposed outwards in the X-axis direction of the casing 1 relative to the pistons 40, 40. The locking direction is set outwards in the X-axis direction of the casing 1. It is thus so arranged that the brake pistons 40, 40 of both the brake units 4, 4 can be urged in the locking direction by a common urging means 43 which is disposed between both. Still furthermore, the right-moving inching unit $5_1$ is disposed on the right side and the left-moving inching unit $5_2$ is disposed on the left side. The inching reaction force receiving members 51, 51 of both the inching units $5_1$, $5_2$ are disposed next to each other inwards in the X-axis direction of the casing 1 so that both the reaction force receiving members 51, 51 can be urged by a common urging mens 54 which is disposed between both.

When the jig is in use, a large thrust force may sometimes be applied to the actuator A through the workpiece receiver c. In order to keep the actuator A in a predetermined position against this thrust force, it is necessary to increase the restricting force by means of the brake units 4, 4. In such a case, it is desired to increase the diameter of the guide member b1 to thereby increase the length of contact with the brake lock member 42. On the other hand, the load at the time of changing the position of the workpiece receiver c is small and, therefore, even if the guide member b2 is small in diameter, the inching reaction force can sufficiently be received by the inching lock members 52, 52 which tighten the guide member b2. Since, in the example shown in FIG. 16, the first guide member b1 is used for the brake units 4, 4 and the second guide member b2 is used for the inching units $5_1$, $5_2$, respectively, the actuator A can be miniaturized to the maximum extent possible by making the second guide member b2 smaller than the first guide member b1. Depending on the actual example of using the actuator A, there may be cases where the load is normally small and becomes large at the time of changing the position. In such a case, the first guide member b1 may be made smaller and the second guide member b2 larger.

Figure 13:
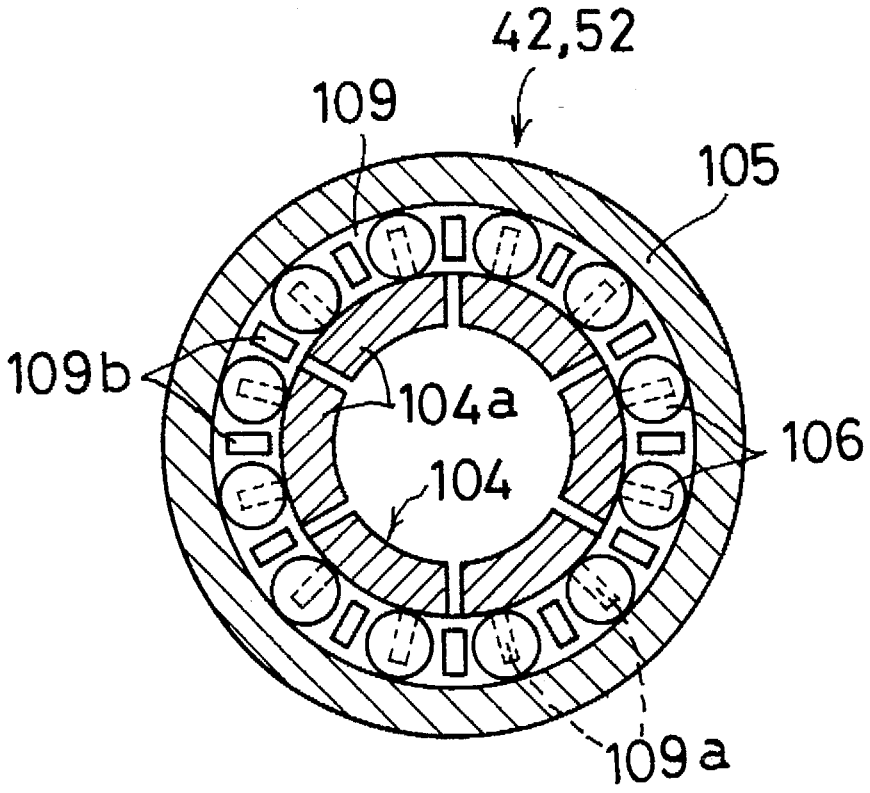
FIG. 13 is a cross-sectional front view of a lock member to be used in the sixth example of the present invention.
Figure 15:
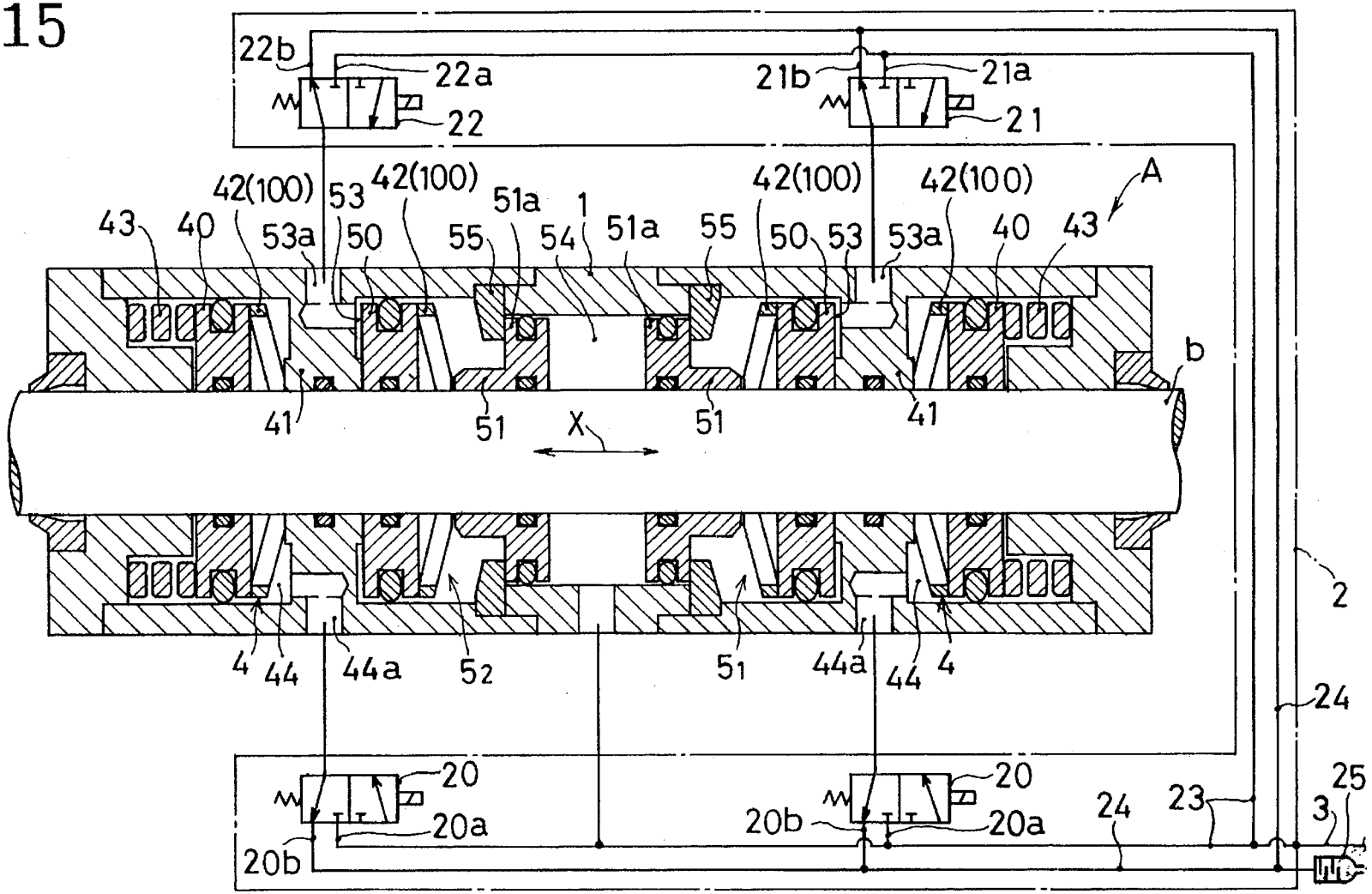
FIG. 15 is a cross-sectional side view of a seventh example of the actuator according to the present invention.

In the examples shown in FIGS. 15 and 16, each of the brake/inching lock members 42, 52 is constituted by a belleville spring like member 100 as shown in FIG. 4. However, they may also be constituted by segment plates 102 as shown in FIG. 8. Still furthermore, each of the brake/inching locking members 42, 52 may respectively be provided with a collet member, in a projecting manner, which is interposed between each of the lock members 42, 52 and the guide member b. Or else, each of the lock members 42, 52 may be constituted by a ball-type collet chuck which is made up, as shown in FIG. 13, of the inner ring 104, the outer ring 105 and the balls 106.

An explanation has so far been made about the actuator A which is provided with the brake units 4, 4 and the inching units $5_1$, $5_2$. It is possible to integrate the brake units into the inching units. An explanation of such an example will now be made hereinbelow.

Figure 17:
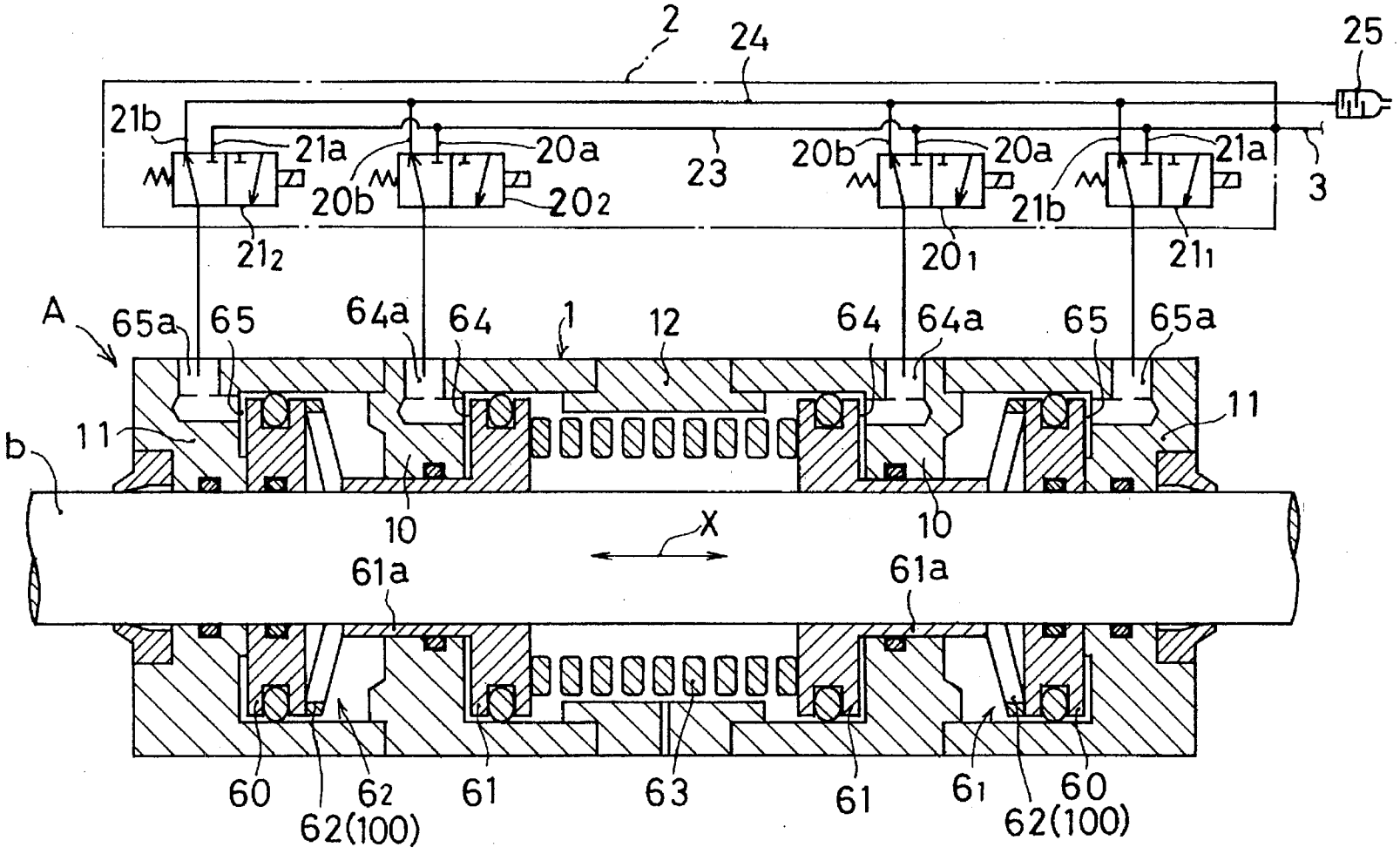
FIG. 17 is a cross-sectional side view of a ninth example of the actuator according to the present invention.

In an actuator A shown in FIG. 17, a right-moving inching unit $6_1$ is built in the right half portion of the casing 1 which is slidably fitted onto an outer surface of the guide member b, and the left-moving inching unit $6_2$ is built in the left half portion of the casing 1.

The right-moving inching unit $6_1$ is provided with: an inching piston 60; a brake piston 61 which is disposed inwards, i.e., to the left, in the X-axis direction of the casing 1 relative to the inching piston 60; a lock member 62 which can tighten the guide member b and which is disposed between the inching piston 60 and the brake piston 61; an urging means 63 which urges the brake piston 61 outwards, i.e., to the right, in the X-axis direction of the casing 1; a first pressure chamber 64 which urges the brake piston 61 to the left; and a second pressure chamber 65 which urges the inching piston 60 to the left. Although the urging means 63 is constituted by a coil spring, it may also be constituted by a pneumatic spring or the like.

To the brake piston 61 there is integrally formed a collar 61*a* which extends to the right through a partition wall 10 fixed to the casing 1 for defining the first pressure chamber 64 together with the brake piston 61. The lock member 62 is constituted, as shown in FIG. 4, by a belleville spring like member 100 in which are formed radial slits 100*a* to extend from an inner periphery up to a diametrically intermediate position. The collar 61*a* of the brake piston 61 is abutted with the left side surface of the inner periphery of the belleville spring like member 100, and the inching piston 60 is abutted with the right side surface of the outer periphery of the belleville spring like member 100. In a condition in which the inching piston 60 is at an outward stroke end position to abut a partition wall 11 which is fixed to the casing 1 for defining therebetween the second pressure chamber 65, the belleville spring like member 100 is pinched between the brake piston 61 and the inching piston 60 by that urging force of the urging means 63 which operates via the brake piston 61. The internal diameter of the belleville spring like member 100 is thus reduced to thereby maintain the locked condition in which the lock member 62 tightens the guide member b.

In this example, the lock member 62 is disposed on the side of the inching piston 60. However, the lock member may also be disposed on the side of the brake piston and a collar which abuts the lock member may be provided in a projecting manner in the inching piston.

The left-moving inching unit $6_2$ has the same construction as the right-moving inching unit $6_1$ except that the directivity is opposite to each other. Therefore, an explanation thereof is omitted by giving the same reference numerals as those of the right-moving inching unit $6_1$ to the same members or parts.

The brake pistons 61, 61 for both the right-moving inching unit $6_1$ and the left-moving inching unit $6_2$ are disposed next to each other inwards in the X-axis direction of the casing 1. Therefore, in this example, both the brake pistons 61, 61 are arranged to be urged outwards in the X-axis direction of the casing 1 by the common urging means 63 which is disposed therebetween. Further, between both the brake pistons 61, 61 there is provided a stopper 12 which is fixed to the casing 1 and which restricts the backward movement position in the X-axis direction of the casing 1.

In the valve block 2 which is mounted on the casing 1, there are provided each valve $20_1$, $20_2$ which is connected to the supply and discharge ports 64*a*, 65*a* of each of the pressure chambers 64, 65 of the right-moving inching unit $6_1$, and each valve $20_2$, $21_2$ which is connected to the supply and discharge ports 64*a*, 65*a* of each of the pressure chambers 64, 65 of the left-moving inching unit $6_2$. Each of these valves $20_1$, $20_2$, $21_1$, $21_2$ is constituted by a solenoid valve and is controlled for switching by a signal from a controller (not illustrated). Air supply ports 20*a*, 21*a* and air discharge ports 20*b*, 21*b* of each of these valves $20_1$, $20_2$, $21_1$, $21_2$ are connected to a common piping material 3 and a silencer 25, which is opened to atmosphere, via manifold passages for air supply and air discharge, respectively, inside the valve block 2. Even in case where each of these valves $20_1$, $20_2$, $21_1$, $21_2$ is independently connected to the casing 1, it is possible to mount the manifold to the casing 1 and to supply air from the common piping material 3 to each of the valves $20_1$, $20_2$, $21_1$, $21_2$.

An explanation will now be made about the operation or function of the actuator A.

Both the first and the second pressure chambers 64, 65 of both the inching unit $6_1$, $6_2$ are opened to atmosphere. In this condition, the inching pistons 60, 60 of both the inching units $6_1$, $6_2$ are respectively at the outward stroke end positions, and the lock members 62, 62 of both the inching units $6_1$, $6_2$ operate to tighten the guide member b. In this case, the leftward thrust force to operate on the actuator A via the workpiece receiver c is received by the lock member 62 of the right-moving inching unit $6_1$ via the rightward partition wall 11 of the casing 1 and the inching piston 60 of the right-moving inching unit $6_1$. The rightward thrust force is received by the lock member 62 of the left-moving inching unit $6_2$ via the leftward partition wall 11 of the casing 1 and the inching piston 60 of the left-moving inching unit $6_2$. The actuator A is thus locked in a certain predetermined position.

Figure 18A:
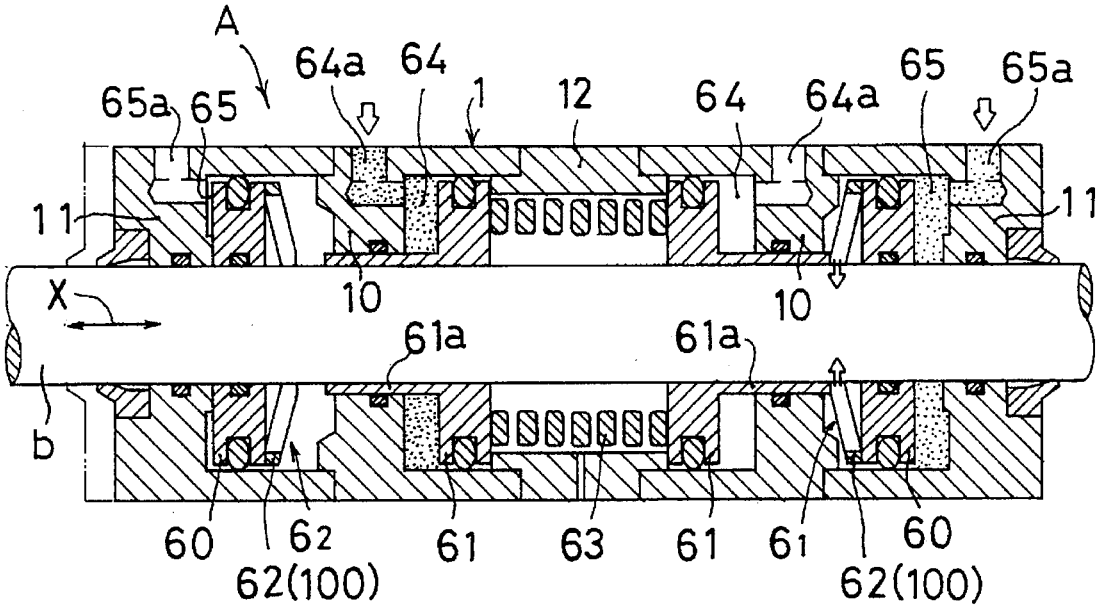
FIGS. 18A and 18B are cross-sectional side views showing the operation of the ninth example.

When the actuator A is moved to the right, first the air pressure is inputted to the second pressure chamber 65 of the right-moving inching unit $6_1$. In this case, since the inching piston 60 of the inching unit $6_1$ is locked relative to the guide member b via the lock member 62, the casing 1 is urged to the right by the reaction force of the air pressure inside the second pressure chamber 65. In this condition the air pressure is also inputted to the first pressure chamber 64 of the left-moving inching unit $6_2$. According to these operations, the brake piston 61 of the left-moving inching unit $6_2$ is retreated inwards against the urging means 63, whereby the lock member 62 of the inching unit $6_2$ becomes the unlocked condition. The casing 1 thus becomes capable of moving to the right and, by the air pressure inside the second pressure chamber 65 of the right-moving inching unit $6_1$, the actuator A inches to the right by an amount equivalent to the stroke of the inching piston 60 of the right-moving inching unit $6_1$, as shown in FIG. 18A. In the illustrated example, the stroke of the inching piston 60 is restricted by the abutment of the stopper 12 with the brake piston 61 of the right-moving inching unit $6_1$. It may also be arranged to restrict the stroke by the abutment of the partition wall with the lock member 62.

Figure 18B:
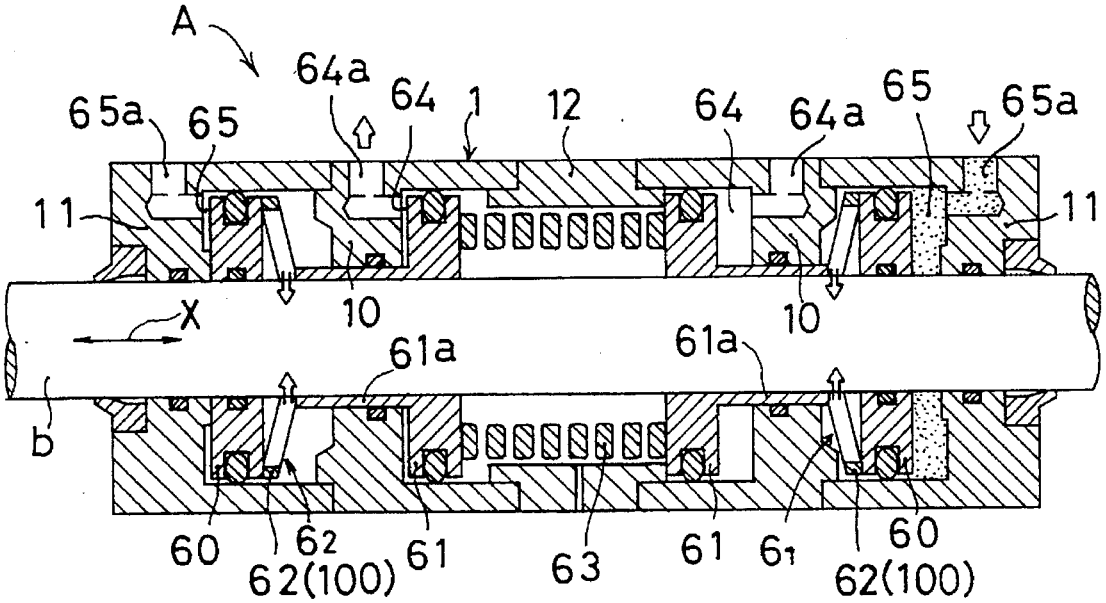

Once the actuator A has inched as described above, the first pressure chamber 64 of the left-moving inching unit $6_2$ is first opened to atmosphere to switch the lock member 62 of the left-moving inching unit $6_2$ to the locked condition as shown in FIG. 18B. Then, the second pressure chamber 65 of the right-moving inching unit $6_1$ is opened to atmosphere. According to these operations, the lock member 62 of the right-moving inching unit $6_1$ is switched to the unlocked condition. By the urging force of the urging means 63 to operate on the brake piston 61 of the right-moving inching unit $6_1$, the inching piston 60 is pushed back to the rightward stroke end position while moving relative to the casing 1 and the guide member b, thereby returning to the condition as shown in FIG. 17.

By repeating the above-described operations, the casing 1 inches to the right by one pitch at the stroke of the inching piston 60 of the right-moving inching unit $6_1$.

By supplying and discharging air to and from the first pressure chamber 64 of the right-moving inching unit $6_1$ and the second pressure chamber 65 of the left-moving inching unit $6_2$, the casing 1 inches, in a similar operation as above, to the left by one pitch at the stroke of the inching piston 60 of the left-moving inching unit $6_2$.

Figure 19:
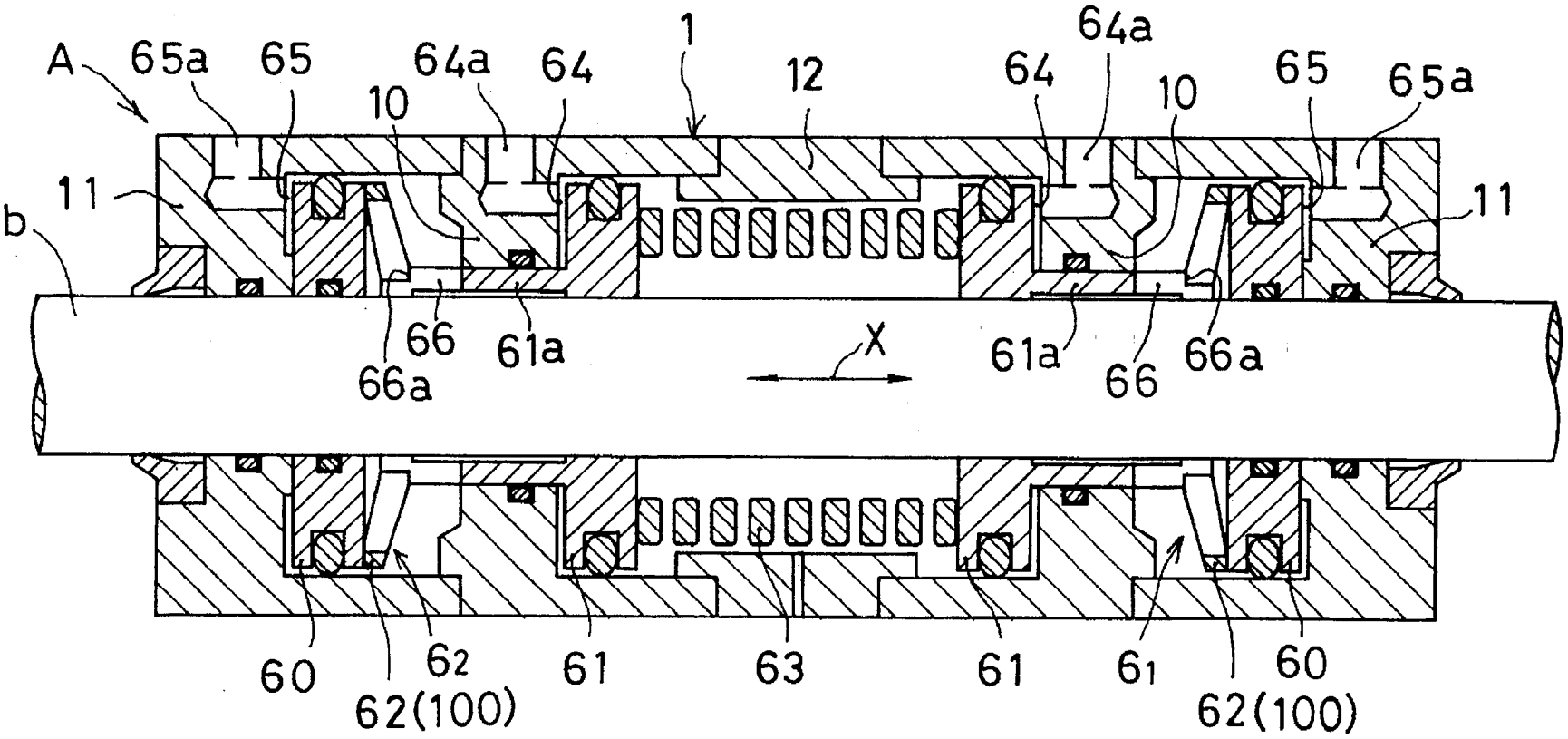
FIG. 19 is a cross-sectional side view of a tenth example of the actuator according to the present invention.

In the example shown in FIG. 17, the lock member 62 is constituted by a belleville spring like member 100. However, as shown in FIG. 19, the following arrangement may also be employed. Namely, a collet member 66 which can be reduced in diameter and which is interposed between the belleville spring like member 100 and the guide member b is provided in a projecting manner in the collar 61*a* of the brake piston 61, whereby the guide member b is tightened by the belleville spring like member 100 via the collet member 66. In this case, on an outer peripheral surface of the collet member 66 there is formed a stepped portion 66*a* which abuts the side surface of the belleville spring like member 100. The belleville spring like member 100 is thus arranged to be pinched in the axial direction between the stepped portion 66*a* and the inching piston 60.

Figure 20:
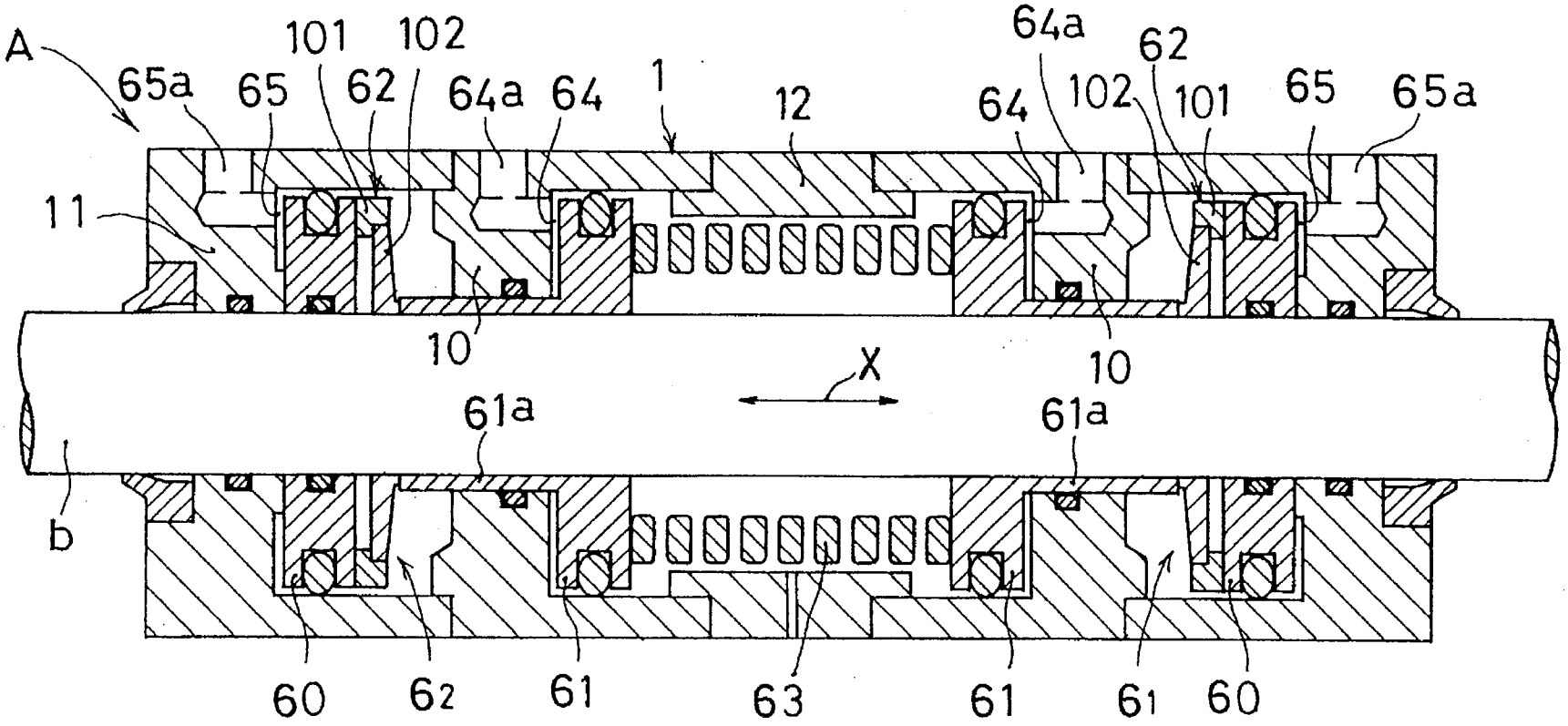
FIG. 20 is a cross-sectional side view of an eleventh example of the actuator according to the present invention.
Figure 21:
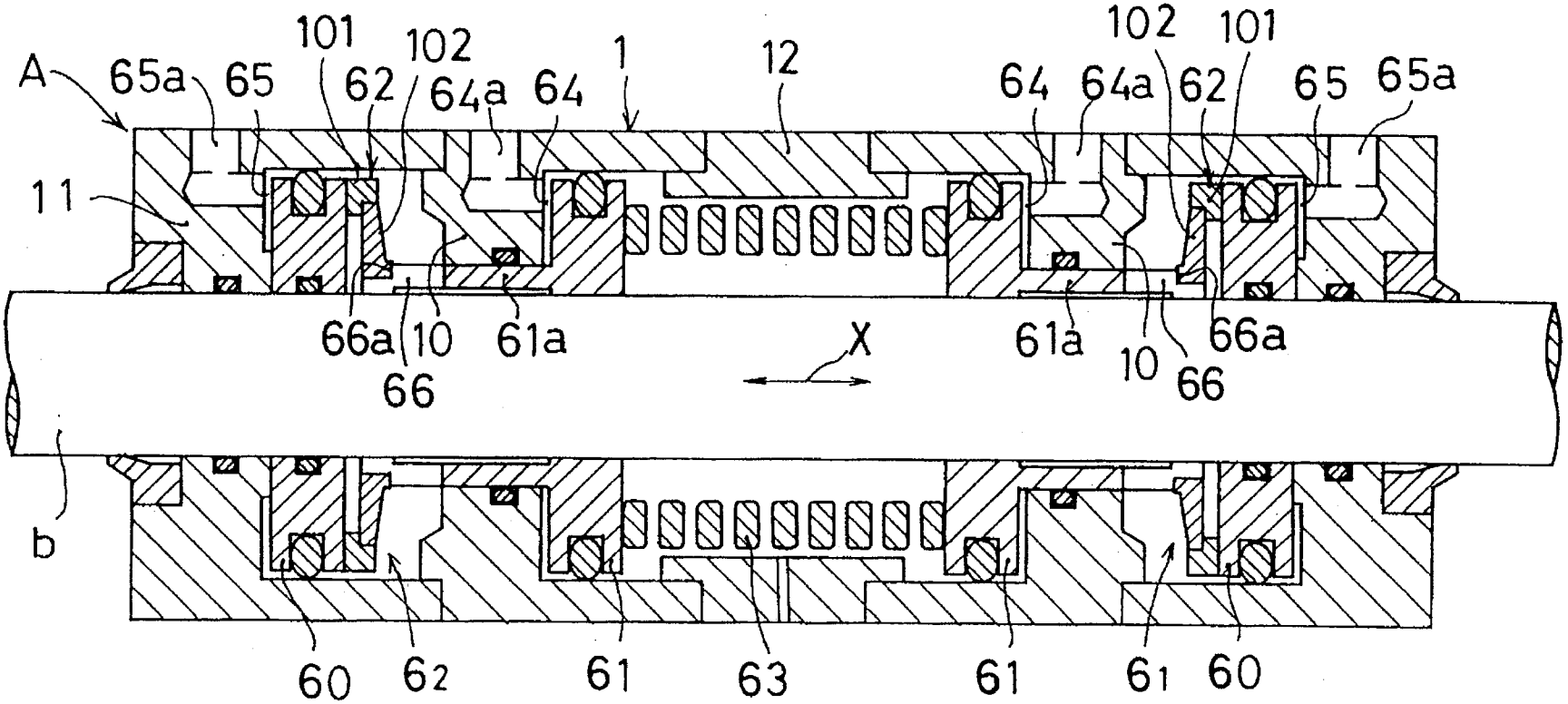
FIG. 21 is a cross-sectional side view of a twelfth example of the actuator according to the present invention.

Further, as in an example shown in FIG. 20, the lock member 62 may also be constituted by an outer ring 101 which is provided on that side surface of the inching piston 60 which lies on the side of the brake piston 61, and a plurality of segment plates 102 which are circumferentially divided, as shown in FIG. 8, and which are supported on the outer diameter portion by the outer ring 101. Further, as in an example shown in FIG. 21, on the collar 61*a* of the brake piston 61 there may be formed a collet member 66 which can be reduced in diameter and which has formed on an outer peripheral surface thereof a stepped portion 66*a* which abuts the side surface of the segment plates 102.

Figure 22:
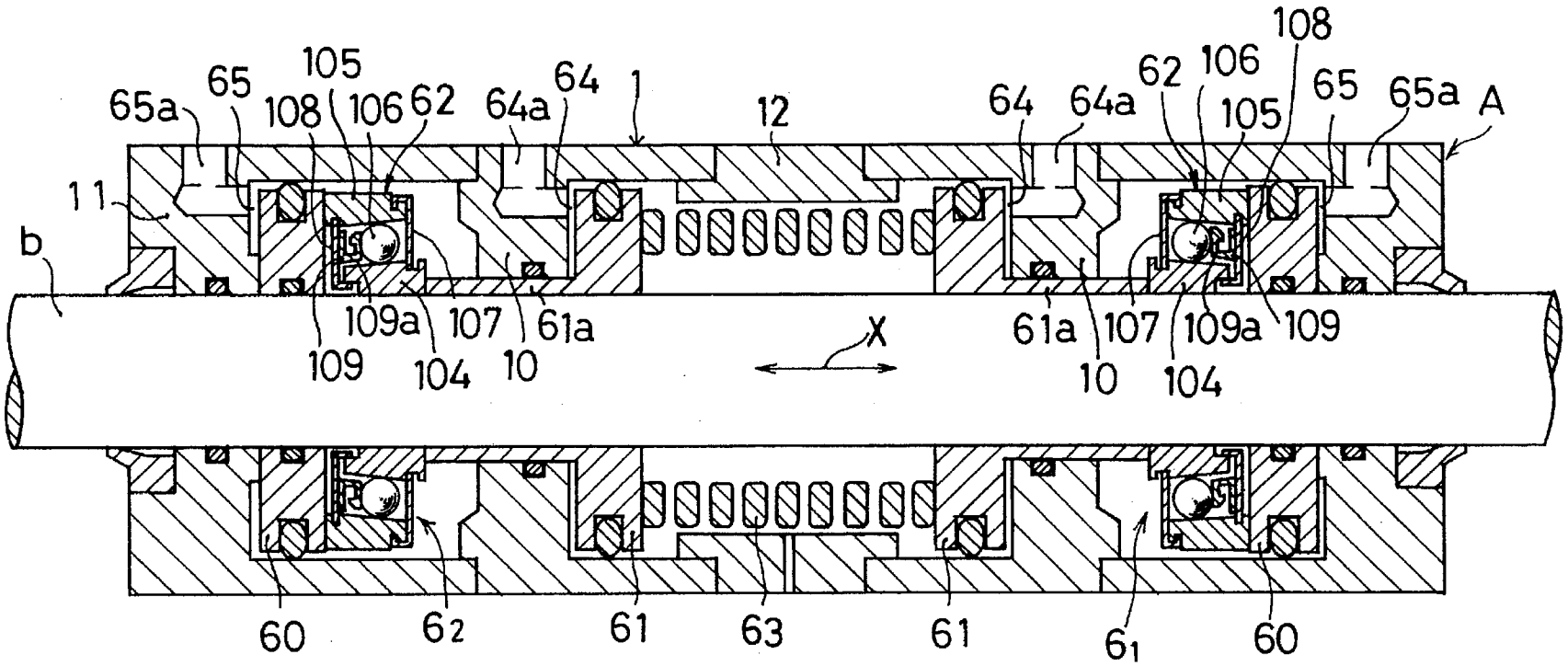
FIG. 22 is a cross-sectional side view of a thirteenth example of the actuator according to the present invention.

Further, the lock member 62 may also be constituted, like an example shown in FIG. 13, by an inner ring 104, an outer ring 105, and a plurality of balls 106 which are interposed between both the rings 104, 105. A collar 61*a* of the brake piston 61 is abutted, as shown in FIG. 22, with one axial end of the inner ring 104, and the inching piston 60 is abutted with the other axial end of the outer ring 105.

Figure 23:
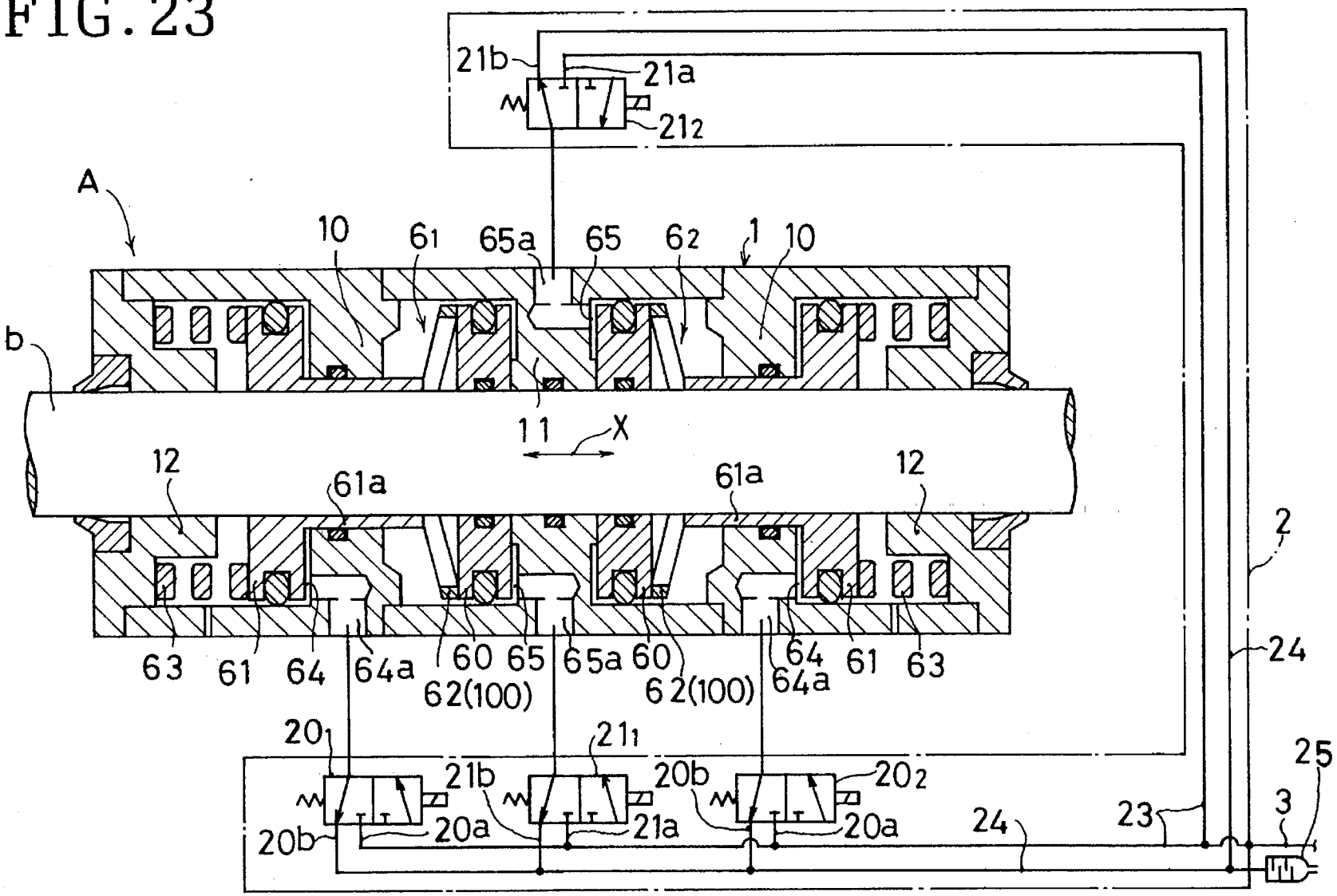
FIG. 23 is a cross-sectional side view of a fourteenth example of the actuator according to the present invention.

In the examples shown in FIGS. 17 through 22, the right-moving inching unit $6_1$ and the left-moving inching unit $6_2$ are built in the right half and the left half of the casing 1, respectively. However, like an example as shown in FIG. 23, the right-moving inching unit $6_1$ may be built in the left half portion of the casing 1 and the left-moving inching unit $6_2$ may be built in the right half portion of the casing 1. In this case, the brake pistons 61, 61 are disposed outward in the X-axis direction of the casing 1 relative to the inching piston 60 of each of the inching units $6_1$, $6_2$. The remaining constitution is the same as in the example shown in FIG. 17, and its explanation is therefore omitted by giving the same reference numerals to the same members or parts. In the example shown in FIG. 23, each of the pressure chambers 64, 65 is disposed inwards in the X-axis direction of the casing 1 relative to each of the pistons 61, 60. As a result, it becomes possible to dispose the supply and discharge ports 64*a*, 65*a* of each of the pressure chambers 64, 65 towards the central portion of the casing 1 in an intensive manner. The valve block 2 can therefore be miniaturized.

Figure 24:
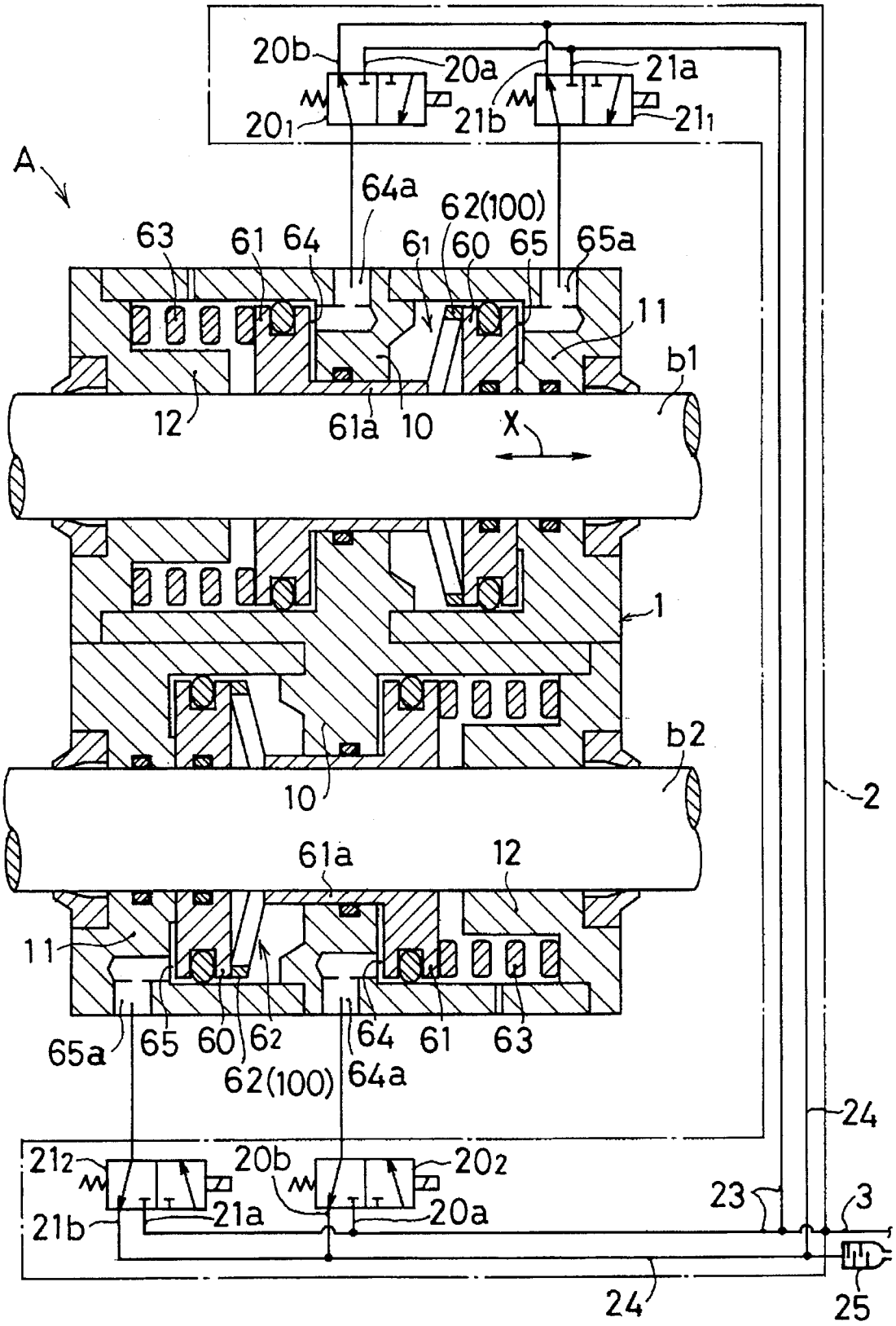
FIG. 24 is a cross-sectional side view of a fifteenth example of the actuator according to the present invention.

Like in an example shown in FIG. 24, the following arrangement may also be employed. Namely, the casing 1 is slidably engaged with a pair of parallely disposed guide members b1, b2. Into this casing 1, the right-moving inching unit $6_1$ is built in the side of one guide member b1 and the left-moving inching unit $6_2$ is built in the side of the other guide member b2.

In the examples shown in FIGS. 23 and 24, the lock member 62 is constituted by a belleville spring like member 100. However, like in the example shown in FIG. 20, it may also be constituted by segment plates 102. Furthermore, between the guide member b and the lock member 62, which is constituted by the belleville spring like member 100 or the segment plates 102, there may be interposed a collet member 66 like in the example shown in FIGS. 19 and 21. Still furthermore, the lock member 62 may be constituted by a ball type collet chuck which is made up of an inner ring 104, an outer ring 105 and balls 106, like in the example shown in FIG. 22.

It is readily apparent that the above-described inchworm type of actuator meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An inchworm type of actuator which moves relative to a bar-like guide member, said actuator comprising:

a brake unit;

a pair of forward-moving and backward-moving inching units, said brake unit and said inching units being built in a casing which is slidable relative to said guide member, said brake unit comprising: a brake piston fitted onto an outer surface of said guide member; a brake reaction force receiving member lying opposite to said brake piston and fixed to said casing; a brake lock member interposed between said brake piston and said brake reaction force receiving member in a condition of being fitted onto the outer surface of said guide member whereby said brake lock member tightens said guide member upon receipt of an urging force from said brake piston toward said brake reaction force receiving member; urging means for urging said brake piston towards said brake reaction force receiving member; and a pressure chamber for urging said brake piston in a direction away from said brake reaction force receiving member, each of said inching units comprising: an inching piston fitted onto the outer surface of said guide member; an inching reaction force receiving member urged in a positive direction towards said inching piston; an inching lock member interposed between said inching piston and said inching reaction force receiving member in a condition of being fitted onto the outer surface of said guide member whereby said inching lock member tightens said guide member upon receipt of an urging force from said inching piston in an opposite direction; and a pressure chamber for urging said inching piston in the opposite direction, the forward-moving direction of said forward-moving inching unit being defined as the positive direction and the backward moving direction thereof as the opposite direction, the backward-moving direction of said backward-moving inching unit being defined as the positive direction and the forward-moving direction thereof as the opposite direction; and fluid supply means for inputting, at the time of forward-moving inching, a fluid pressure into said pressure chamber of said forward-moving inching unit and said pressure chamber of said brake unit and for inputting, at the time of backward-moving inching, the fluid pressure into said pressure chamber of said backward-moving inching unit and said pressure chamber of said brake unit.

2. An inchworm type of actuator according to claim 1, wherein said brake unit is built in a central portion in an X-axis direction of said casing, and wherein said forward-moving inching unit and said backward-moving inching unit are built in axially one end and the other end, respectively, of said casing, the X-axis direction being defined to be a longitudinal direction of said guide member.

3. An inchworm type of actuator according to claim 1, wherein said brake unit is disposed in a pair in a central portion in the X-axis direction of said casing such that said brake piston of each of said brake units is positioned inwards in the X-axis direction relative to said brake reaction force receiving member of each of said brake units, and wherein said urging means is constituted by a common urging means disposed between said brake pistons of both said brake units.

4. An inchworm type of actuator according to claim 2 or 3, wherein said forward-moving inching unit and said backward-moving inching unit are disposed such that the positive direction of both said inching units looks inwards in the X-axis direction of said casing.

5. An inchworm type of actuator according to claim 1, wherein said brake unit is built in at least one of both ends in an X-axis direction of said casing, the X-axis direction being defined to be in the longitudinal direction of said guide member.

6. An inchworm type of actuator according to claim 5, wherein said brake unit is disposed in a pair at both end portions-in the X-axis direction of said casing such that said brake piston of each of said brake units is positioned outwards in the X-axis direction relative to said brake reaction force receiving member of each of said brake units.

7. An inchworm type of actuator according to claim 5 or 6, wherein said forward-moving inching unit and said backward-moving inching unit are respectively disposed such that the positive direction of both said inching units looks outwards in the X-axis direction of said casing, and wherein both said reaction force receiving members of both said inching units are urged in the positive direction by a common urging means provided between said reaction force receiving members of both said inching units.

8. An inchworm type of actuator according to claim 1, wherein said guide member is disposed in a pair in parallel with each other, said casing being slidably engaged with both said guide members, and wherein said casing has built therein said brake unit positioned on one of said guide members and said forward-moving inching unit and said backward-moving inching unit positioned on the other of said guide members.

9. An inchworm type of actuator according to claim 8, wherein said brake unit is disposed in a pair such that said brake piston of each of said brake units is positioned inwards in the X-axis direction of said casing relative to said brake reaction force receiving member, the X-axis being defined to be in a longitudinal direction of said guide member, and wherein said urging means for each of said brake units is constituted by a common urging means disposed between said brake pistons of both said brake units.

10. An inchworm type of actuator according to claim 8 or 9, wherein said forward-moving inching unit and said backward-moving inching unit are disposed such that said positive direction of both said inching units looks outwards in the X-axis direction of said casing, the X-axis being defined to be in a longitudinal direction of said guide member, and wherein both said inching reaction force receiving members are urged in the positive direction by a common urging means disposed between said inching reaction force receiving members of both said inching units.

11. An inchworm type of actuator according to claim 1, wherein each of said brake lock member and said inching lock member is constituted by a belleville spring like member whose inner diameter can be reduced when an urging force from each of said brake piston and said inching piston is received.

12. An inchworm type of actuator according to claim 1, wherein each of said brake lock member and said inching lock member comprises: an outer ring integrally or separately provided on that side surface of each of said brake piston and said inching piston which lies on a side of said brake reaction force receiving member and said inching reaction force receiving member, respectively; and a plurality of circumferentially divided segment plates supported at their outer diameter portion by said outer ring; and wherein each of said segment plates is inclined, when an urging force from each of said pistons is received, to a direction to reduce an inclination angle within a range in which said inclination angle exists, said inclination angle being formed relative to a plane perpendicular to said guide member by a line connecting a corner of each of said segment plates in an outer diameter portion thereof on a side of each of said pistons and a corner of said segment plates in an inner diameter portion thereof on a side of each of said reaction force receiving members, whereby a tightening force to said guide member is generated.

13. An inchworm type of actuator according to claim 12, further comprising a spring element interposed between said segment plates and each of said pistons such that said spring element is compressed by the inclination of said segment plates.

14. An inchworm type of actuator according to claim 12, wherein said inclination angle in a condition in which said segment plates of said brake lock member are inclined upon receipt of an urging force from said brake piston is set relatively large, and wherein said inclination angle in a condition in which said segment plates of said inching lock member are inclined upon receipt of an urging force from said inching piston is set relatively small.

15. An inchworm type of actuator according to claim 1, 11 or 12, wherein said inching reaction force receiving member further comprises a collet member provided in a manner projecting therefrom for interposing between said inching lock member and said guide member, said collet member having a stepped portion on an outer peripheral surface thereof for abutting that side surface of said inching lock member which lies away from said inching piston.

16. An inchworm type of actuator according to claim 1, 11 or 12, wherein said brake reaction force receiving member further comprises a collet member provided in a manner projecting therefrom for interposing between said brake lock member and said guide member, said collet member having a stepped portion on an outer peripheral surface thereof for abutting that side surface of said brake lock member which lies away from said brake piston.

17. An inchworm type of actuator according to claim 1, wherein each of said brake lock member and said inching lock member comprises: an inner ring fitted onto an outer surface of said guide member and reducible in diameter; an outer ring enclosing said inner ring with a clearance therebetween; and a plurality of balls interposed between said inner ring and said outer ring, wherein one and the other of said brake piston and said inching piston and one and the other of said brake reaction force receiving member and said inching reaction force receiving member are respectively abutted with one and the other axial ends of said inner ring and said outer ring, and wherein an outer peripheral surface of said inner ring and an inner peripheral surface of said outer ring are formed into tapered surfaces respectively having a larger diameter towards one axial end thereof.

18. An inchworm type of actuator according to claim 17, wherein a taper angle of said outer peripheral surface of said inner ring is larger than a taper angle of said inner peripheral surface of said outer ring, each of said brake lock member and said inching lock member further comprising ball retainers for holding said balls by urging them towards one axial end.

19. An inchworm type of actuator according to claim 17 or 18, wherein an inclination angle of a line connecting a contact point of said ball with the outer peripheral surface of said inner ring and a contact point of said ball with the inner peripheral surface of said outer ring relative to a plane perpendicular to said guide member is set relatively large in said brake lock member and is set relatively small in said inching lock member.

20. An inchworm type of actuator according to claim 1, wherein said forward-moving inching unit and said backward-moving inching unit are respectively built in one and the other of halves in an axial direction of said casing, the axial direction being defined to be a longitudinal direction of said guide member.

21. An inchworm type of actuator according to claim 20, wherein said forward-moving inching unit and said backward-moving inching unit are respectively disposed such that the positive direction of both said inching units looks outwards in the X-axis direction of said casing.

22. An inchworm type of actuator according to claim 21, wherein said urging means of each of said inching units is constituted by a common urging means provided between both said brake pistons.

23. An inchworm type of actuator according to claim 20, wherein said forward-moving inching unit and said backward-moving inching unit are respectively disposed such that the positive direction of both said inching units looks inwards in the X-axis direction of said casing.

24. An inchworm type of actuator which moves relative to a bar-like guide member, said actuator comprising:

a forward-moving inching unit;

a backward-moving inching unit, each of said inching units being built in a casing which is slidable relative to said guide member;

each of said inching units comprising: an inching piston; a brake piston disposed in a direction opposite to said inching piston; a lock member disposed between said inching piston and said brake piston to tighten said guide member when pinched between both said pistons; urging means for urging said brake piston in a positive direction; a first pressure chamber for urging said brake piston in an opposite direction; and a second pressure chamber for urging said inching piston in the opposite direction, the forward-moving direction of said forward-moving inching unit being defined as the positive direction and the backward-moving direction thereof as the opposite direction, the backward-moving direction of said backward-moving inching unit being defined as the positive direction and the forward-moving direction thereof as the opposite direction; and fluid supply means for inputting, at the time of forward-moving inching, a fluid pressure into said second pressure chamber of said forward-moving inching unit and said first pressure chamber of said backward-moving inching unit and for inputting, at the time of backward-moving inching, the fluid pressure into said second pressure chamber of said backward-moving inching unit and said first pressure chamber of said forward-moving inching unit.

25. An inchworm type of actuator according to claim 24, wherein said guide member is disposed in a pair in parallel with each other, said casing being slidably engaged with both said guide members, and wherein said casing has built therein said forward-moving inching unit positioned on one of said guide members and said backward-moving inching unit positioned on the other of said guide members.

26. An inchworm type of actuator according to claim 24, wherein said lock member is constituted by a belleville spring like member whose inner diameter can be reduced when pinched between said inching piston and said brake piston.

27. An inchworm type of actuator according to claim 24, wherein said lock member comprises: an outer ring integrally or separately provided on that side surface of one of said inching piston and said brake piston which lies on the side of the other of said inching piston and said brake piston; and a plurality of circumferentially divided segment plates supported at their outer diameter portion by said outer ring; and wherein each of said segment plates is inclined, when pinched between said inching piston and said brake piston, to a direction to reduce an inclination angle within a range in which said inclination angle exists, said inclination angle being formed relative to a plane perpendicular to said guide member by a line connecting a corner of each of said segment plates in an outer diameter portion thereof on a side of one of said pistons and a corner of said segment plates in an inner diameter portion thereof on the side of the other of said pistons, whereby a tightening force to said guide member is generated.

28. An inchworm type of actuator according to claim 27, further comprising a spring element interposed between said segment plates and each of said pistons such that said spring element is compressed by the inclination of said segment plates.

29. An inchworm type of actuator according to any one of claims 24, 26 and 27, wherein one or the other of said inching piston and said brake piston further comprises a collet member interposed between said lock member and said guide member, said collet member having a stepped portion on an outer peripheral surface thereof, said stepped portion abutting that side surface of said lock member which lies away from the other of said pistons.

30. An inchworm type of actuator according to claim 20, wherein each of said lock members comprises: an inner ring fitted onto an outer surface of said guide member and reducible in diameter; an outer ring enclosing said inner ring with a clearance therebetween; and a plurality of balls interposed between said inner ring and said outer ring, wherein one and the other of said brake piston and said inching piston are respectively abutted with one axial end of said inner ring and the other axial end of said outer ring, and wherein an outer peripheral surface of said inner ring and an inner peripheral surface of said outer ring are formed into tapered surfaces respectively having a larger diameter towards one axial end thereof.

31. An inchworm type of actuator according to claim 30, wherein a taper angle of said outer peripheral surface of said inner ring is larger than a taper angle of said inner peripheral surface of said outer ring, each of said lock members further comprising ball retainers for holding said balls by urging them towards one axial end.

* * * * *

UNITED STATES PATENT AND TRADEMARK OFFICE

CERTIFICATE OF CORRECTION

PATENT NO.: 5,662,020
DATED : September 2, 1997
INVENTORS : Hirobumi MORITA, et al.

It is certified that error appears in the above-identified patent and that said Letters Patent is hereby corrected as shown below:

Column 26, line 1, change "1" to read --24--;
line 3, after "one" add --half--; and
line 4, change "of halves" to read --half--.

Signed and Sealed this

Third Day of March, 1998

*Attest:*

*Attesting Officer*

BRUCE LEHMAN

*Commissioner of Patents and Trademarks*